US006871391B2

(12) United States Patent
Tokuda et al.

(10) Patent No.: US 6,871,391 B2
(45) Date of Patent: Mar. 29, 2005

(54) METHOD OF MANUFACTURING LAMINATED CERAMIC ELECTRONIC COMPONENT AND LAMINATED CERAMIC ELECTRONIC COMPONENT

(75) Inventors: Hiromichi Tokuda, Omihachiman (JP); Takashi Tomohiro, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 106 days.

(21) Appl. No.: 10/041,065

(22) Filed: Nov. 9, 2001

(65) Prior Publication Data

US 2002/0105788 A1 Aug. 8, 2002

(30) Foreign Application Priority Data

Nov. 9, 2000 (JP) ..... 2000-342221

(51) Int. Cl.[7] ..... H01F 7/06

(52) U.S. Cl. ..... 29/602.1; 156/89.11; 336/83; 336/200

(58) Field of Search ..... 336/83, 65, 200, 336/223, 232; 29/602.1, 603.2, 609, 738, 605–607; 156/89.11–89.16

(56) References Cited

U.S. PATENT DOCUMENTS 5,948,200 A * 9/1999 Nakazawa et al. ..... 156/248

FOREIGN PATENT DOCUMENTS

| | | |
|---|---|---|
| JP | 56-155516 | 12/1981 |
| JP | 6-045307 | 6/1994 |
| JP | 7-045461 A | 2/1995 |
| JP | 8-186047 A | 7/1996 |

* cited by examiner

*Primary Examiner*—Tuyen T. Nguyen
(74) *Attorney, Agent, or Firm*—Keating & Bennett, LLP

(57) ABSTRACT

In a method of manufacturing a laminated ceramic electronic component, a first transfer sheet in which a composite green sheet having a non-magnetic ceramic area and a magnetic ceramic area is supported by a supporting film, and a second transfer sheet in which a ceramic green sheet is supported by a supporting film are prepared. The method includes the first transfer step of sequentially transferring the ceramic green sheet onto a lamination stage, the second transfer step of transferring the composite green sheet, the third transfer step of transferring the ceramic green sheet of the second transfer sheet, and the step of obtaining a laminate.

14 Claims, 26 Drawing Sheets

METHOD OF MANUFACTURING LAMINATED CERAMIC ELECTRONIC COMPONENT AND LAMINATED CERAMIC ELECTRONIC COMPONENT

BACKGROUND OF THE INVENTION

1. Field of the Invention

The present invention relates to a method of manufacturing a laminated ceramic electronic component such as a laminated inductor, a laminated common mode choke coil, and other such devices, and more particularly, the present invention relates to a method of manufacturing a laminated ceramic electronic component in which the lamination process is carried out by a transfer process and to the laminated ceramic electronic component.

2. Description of the Related Art

Conventionally, laminated coils produced by a ceramic integration firing technique have been known as inductance components that can be reduced in size. For example, Japanese Unexamined Patent Publication No. 56-155516 discloses an open magnetic circuit type laminated coil as an example of the above-mentioned type laminated inductor. In the manufacturing of this device, first, magnetic ceramic paste is printed several times to form an outer lower-layer portion of the inductor. Next, conductors each constituting a portion of the coil and magnetic paste are alternately printed, so that the coil conductor is formed. While the coil conductor is formed by printing, non-magnetic paste is printed instead of the magnetic paste. After the coil conductor is printed, the magnetic paste is printed several times to form an upper outer layer. The laminate produced in this manner is pressed in the thickness direction thereof, and is fired, whereby the open magnetic circuit type laminated coil is produced.

According to the above-described method of producing an open magnetic circuit type laminated coil, the magnetic or non-magnetic paste and the conductor paste are printed and laminated to product a laminate. In the printing and lamination technique, printing is further carried out in an area in which printing is previously carried out. Accordingly, for example, the height of an area where the conductor constituting the coil conductor is printed is different from that of the other area. This causes a problem in that the flatness of a base for printing is insufficient. For this reason, blurring and other problems occur when the magnetic paste, the non-magnetic paste, or the conductor is printed. Thus, it is difficult to form a desired laminated coil highly accurately.

Moreover, in the above-described printing and lamination technique, it is necessary to prepare the magnetic paste, the non-magnetic paste, and the conductor paste by using materials having a high compatibility with a printing base, respectively. Thus, these types of components have limitations and problems.

Moreover, according to the above-described printing and lamination technique, paste after printing is required to be dried to some degree before the next printing. Accordingly, it takes a long time to carry out the process and the process is very complicated. In addition, it is difficult to reduce the cost of the laminated coil.

SUMMARY OF THE INVENTION

In order to overcome the problems described above, preferred embodiments of the present invention provide a laminated ceramic electronic component and a method of manufacturing the same, that solves the above-described defects of the conventional techniques, and in which a conductor is formed inside a sintered ceramic body, and the conductor and the inner structure of the sintered ceramic body are formed highly accurately and reliably via a greatly simplified process that significantly reduces the cost of the component.

According to preferred embodiments of the present invention, a method of manufacturing a laminated ceramic electronic component includes the steps of preparing a first transfer sheet including a composite green sheet supported by a first supporting film, the composite green sheet having a conductor and a first ceramic area and/or a second ceramic area formed in a region excluding a location where the conductor is provided, preparing a second transfer sheet including a ceramic green sheet supported by a second supporting film, a first transfer step of transferring the ceramic green sheet of at least one second transfer sheet therefrom on a lamination stage, a second transfer step of transferring the composite green sheet from at least one first transfer sheet on the at least one ceramic green sheet previously transferred and laminated, a third transfer step of transferring the ceramic green sheet of at least one second transfer sheet therefrom on the composite green sheet previously transferred and laminated, and firing a laminate obtained by the first, second and third transfer steps.

Preferably, a plurality of the first transfer sheets are prepared, and the conductors are formed so that by the lamination, the conductors of the plurality of the composite green sheets are connected to form a coil.

Also, preferably, at least one of the plurality of the conductors is a via hole electrode for connecting the upper and lower conductors.

More preferably, at least one of the plurality of the conductors is a via hole electrode for connecting the upper and lower conductors.

Preferably, the first ceramic area is made of a magnetic ceramic, and a second ceramic area is made of a non-magnetic ceramic.

More preferably, a method of manufacturing a laminated ceramic electronic component further includes forming the magnetic ceramic area and the non-magnetic ceramic area by printing magnetic ceramic paste and non-magnetic ceramic paste, respectively.

Preferably, a method of manufacturing a laminated ceramic electronic component further includes the steps of forming the first and/or second ceramic areas except a region where a via hole electrode is to be formed, and thereafter filling the region with an electrically conductive paste to form the via hole electrode.

More preferably, a method of manufacturing a laminated ceramic electronic component further includes the steps of forming a through hole in which a via hole electrode is to be formed after preparing the composite ceramic green sheet, and filling the through hole with an electrically conductive paste to form the via hole electrode.

Preferably, a method of manufacturing a laminated ceramic electronic component further includes the steps of preparing a third transfer sheet in which a second composite green sheet having a magnetic ceramic area and a non-magnetic ceramic area is supported by a third supporting film, and transferring the second composite green sheet from at least one third transfer sheet between the first transfer step and the third transfer step.

According to other preferred embodiments of the present invention, a laminated ceramic electronic component is produced by the above-described method of manufacturing a laminated ceramic electronic component, and includes the sintered ceramic body, and a plurality of external electrodes disposed on the outer surface of the sintered ceramic body and electrically connected to the conductors in the sintered ceramic body.

According to another preferred embodiment of the present invention, a laminated ceramic electronic component includes a sintered ceramic body, at least one coil conductor arranged in the sintered ceramic body and having a winding portion and first and second lead-out portions, a plurality of external electrodes disposed on the outer surface of the sintered ceramic body and electrically connected to an end of the first lead-out portion or an end of the second lead-out portion, the sintered ceramic body including a magnetic ceramic and a non-magnetic ceramic, the winding portion of the coil conductor being coated with the non-magnetic ceramic, and the first and second lead-out portions of the coil conductor being coated with the non-magnetic ceramic.

Other features, elements, characteristics and advantages of the present invention will become more apparent from the following detailed description of preferred embodiments with reference to the attached drawings.

DETAILED DESCRIPTION OF PREFERRED EMBODIMENTS

The present invention will be more apparent from the following description of preferred embodiments of the present invention.

Figure 1:
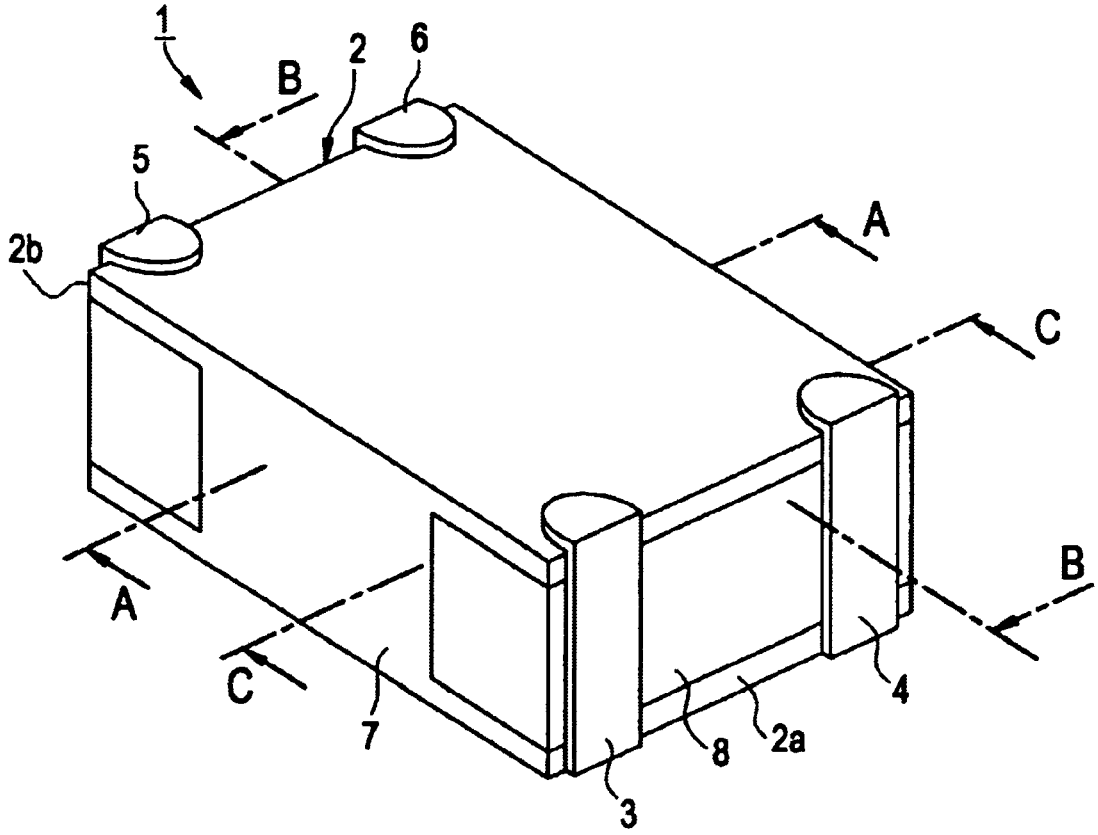
FIG. 1 shows an appearance of a laminated ceramic electronic component according to a first preferred embodiment of the present invention.

FIG. 1 is a perspective view showing the appearance of a laminated ceramic electronic component according to a first preferred embodiment of the present invention. A laminated ceramic electronic component 1 is a closed magnetic circuit type laminated common mode choke coil.

The laminated ceramic electronic component 1 preferably includes a substantially rectangular parallelepiped sintered ceramic body 2. First and second external electrode 3 and 4, and third and fourth external electrodes 5 and 6 are located on the outer surface of the sintered ceramic body 2. The external electrode 3 and 4 are disposed on one 2*a* of the side surfaces of the sintered ceramic body 2. The external electrodes 5 and 6 are disposed on the side surface 2*b* that is opposite to the side surface 2*a* of the external electrodes 5 and 6.

Figure 2A:
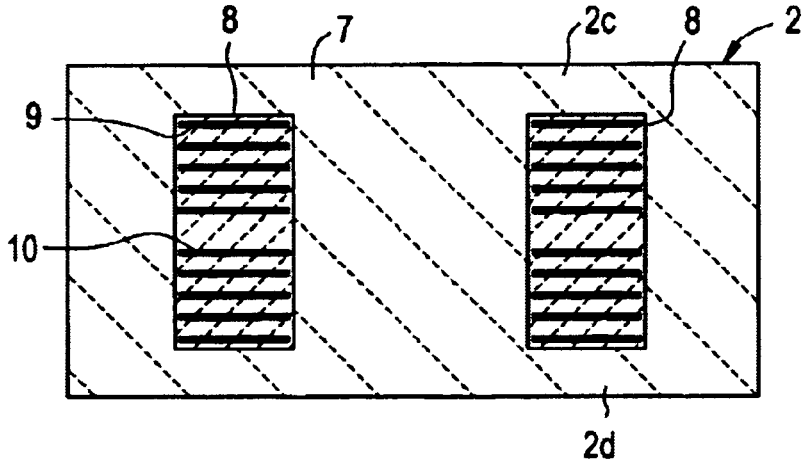
FIGS. 2A, 2B, and 2C are cross sectional views taken along lines A—A, B—B, and C—C in FIG. 1.
Figure 2B:
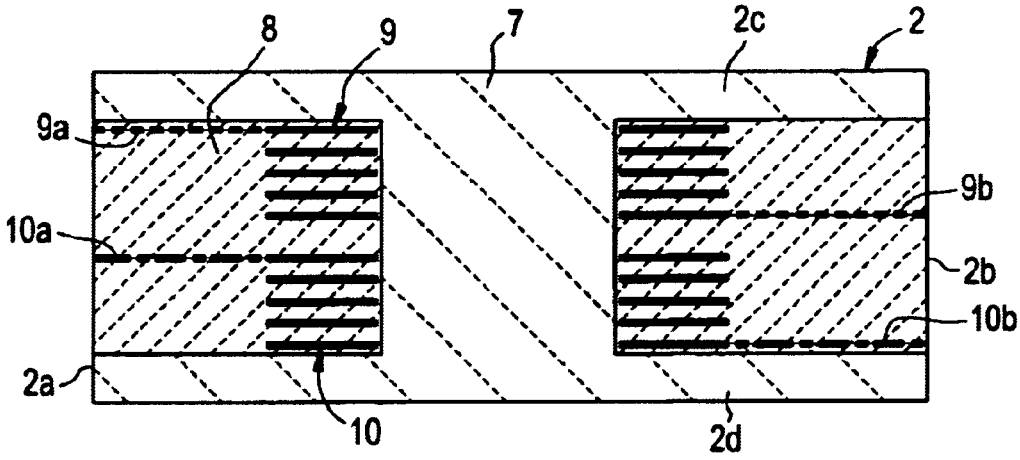

FIG. 2A is a cross sectional view taken along line A—A in FIG. 1. FIG. 2B is a cross sectional view taken along line B—B in FIG. 1. FIG. 20 is a cross sectional view taken along line C—C in FIG. 1.

The sintered ceramic body 2 preferably includes a magnetic ceramic 7 and a non-magnetic ceramic 8. First and second coils 9 and 10 are disposed inside the portion of the sintered ceramic body 2, which is made of the non-magnetic ceramic 8. The coils 9 and 10 are wound so as to extend in the thickness direction of the sintered ceramic body 2. The lead-out portion 9*a* on the upper surface of the coil 9 is led to the side surface 2*a* of the sintered ceramic body 2. The lead-out portion 9*b* on the lower surface of the coil 9 is led to the side surface 2*b*. Moreover, the lead-out portion 10*a* on the upper surface of the coil 10 is led to the side surface 2*a*. The lead-out portion 10*b* on the lower surface is led to the end surface 2*b*.

In FIG. 2B, which is a cross sectional view taken along the line B—B in FIG. 1, the coil lead-out portions 9*a* and 9*b* are shown by broken lines, respectively. The coil lead-out portions 10*a* and 10*b* can not be shown, since they lie in the position nearer to the front surface of the drawing sheet than that shown in the FIG. 2B. However, for easy understanding, the positions are imaginarily shown by alternate long and short dash lines.

FIG. 14B, FIG. 20B, FIG. 22B, and FIG. 24B show the positions similarly to FIG. 2.

The lead-out portions 9*a* and 10*a* of the coils 9 and 10 that are led to the side surface 2*a* are electrically connected to the external electrodes 3 and 4. On the other hand, the lead-out portions 9*b* and 10*b* of the coils 9 and 10 are connected to the external electrodes 5 and 6 on the side end 2*b* respectively.

Thus, the first and second coils 9 and 10 are arranged so as to be separated from each other in the thickness direction in the sintered ceramic body 2. Moreover, the upper and lower portions of the coils 9 and 10 disposed in the non-magnetic ceramic 8 are made of the magnetic ceramic 7.

A method of producing the laminated ceramic electronic component 1 according to preferred embodiments of the present invention will be described with reference to FIGS. 3 to 12.

Figure 2C:
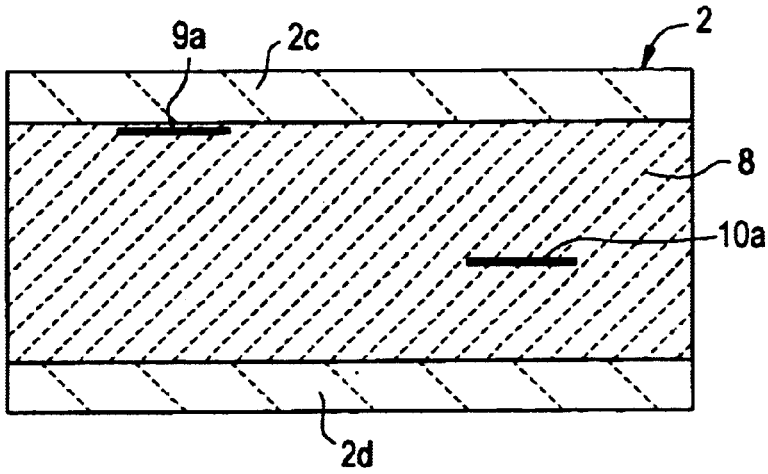
Figure 3A:
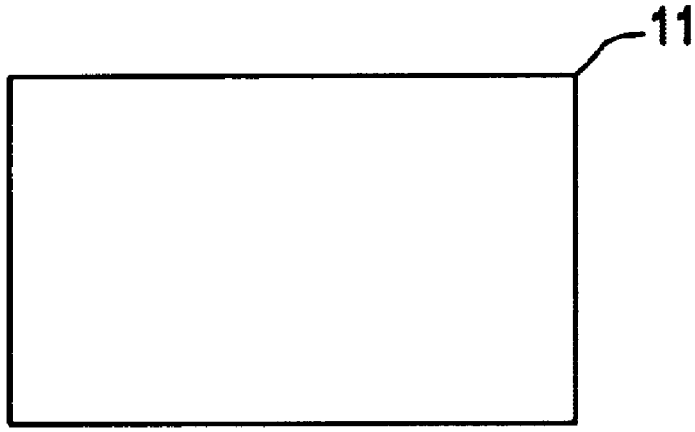
FIGS. 3A and 3B are plan views illustrating processes for forming a second transfer sheet according to the first preferred embodiment of the present invention.
Figure 3B:
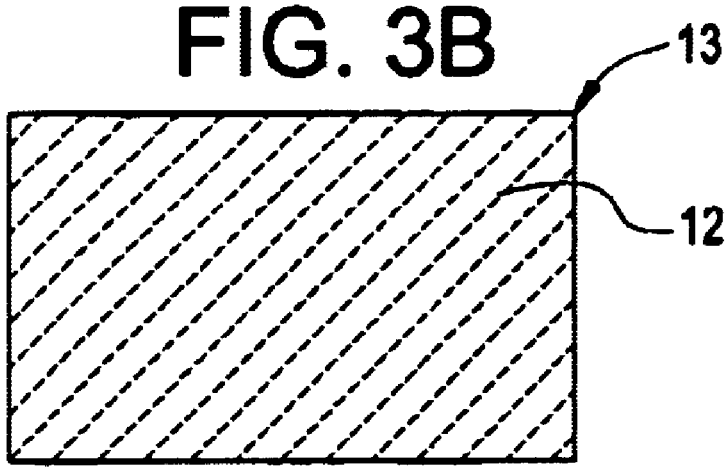

First, to form the outer layer portions 2*c* and 2*d* of the electronic component 1 shown in FIGS. 2A to 2C, a plurality of second transfer sheets are prepared. In particular, a second supporting film 11 made of synthetic resin, such as polyethylene terephthalate film or other suitable material, is prepared, as shown in FIG. 3A. Then, magnetic ceramic paste is screen-printed on the upper a surface of the second supporting film 11 to form a substantially rectangular ceramic green sheet 12 as shown in FIG. 3B. Similarly, a second transfer sheet 13 including the magnetic ceramic green sheet 12 supported by the supporting film 11 is prepared.

Figure 4A:
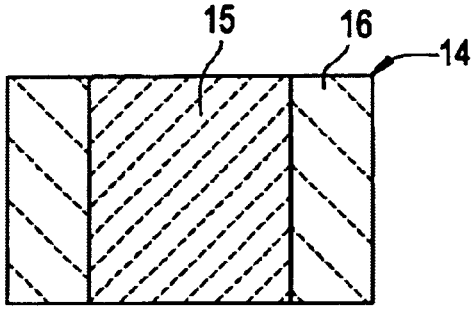
FIG. 4A to 4F are plan views showing a composite green sheet prepared to produce the laminated ceramic electronic component of the first preferred embodiment of the present invention.

On the other hand, to form the portion of the electronic component 1 sandwiched between the outer layer portions 2*c* and 2*d*, sheets shown in FIGS. 4A to 4F, FIGS. 5A to 5E, and FIGS. 6A to 6F are prepared. The third composite green sheet 14 shown in FIG. 4A preferably includes a magnetic ceramic area 15 defining a first ceramic area and a non-magnetic ceramic area 16 defining a second ceramic area. In FIGS. 4A to 6F, the magnetic ceramics and the non-magnetic different directions, as shown in FIG. 4A.

Figure 7A:
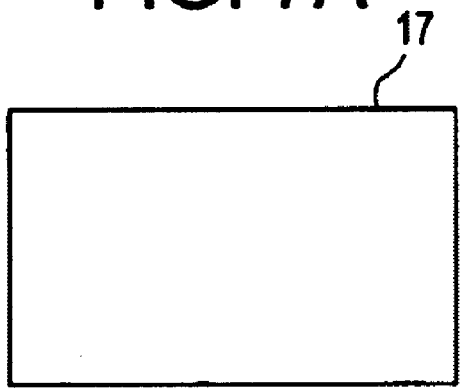
FIGS. 7A to 7C are plan views illustrating a process of preparing a third transfer sheet which is prepared according to the first preferred embodiment of the present invention.
Figure 7B:
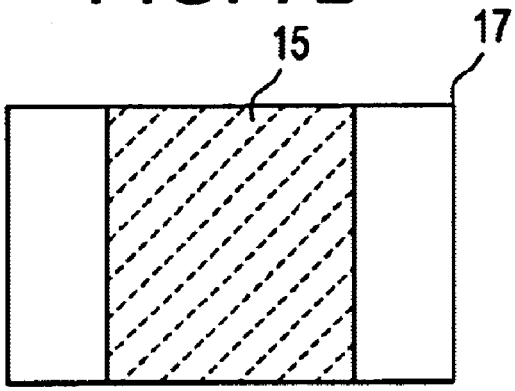

To obtain the composite ceramic green sheet 14, a third supporting film 17 made of synthetic resin such as polyethylene terephthalate or other suitable material is prepared as shown in FIG. 7A. Next, magnetic ceramic paste is printed on the supporting film 17 to form the magnetic ceramic area 15 as the first ceramic area as shown in FIG. 7B.

Figure 7C:
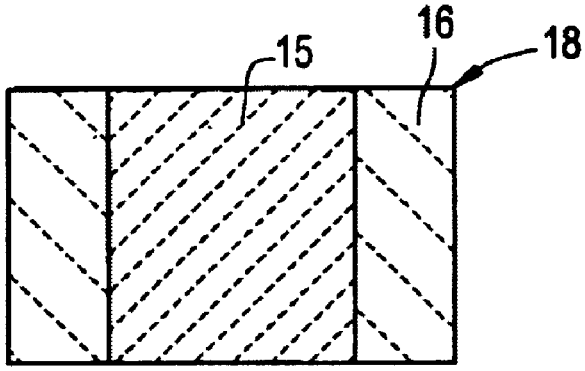

Next, non-magnetic paste is printed onto the portion of the supporting film 17 where the magnetic ceramic area 15 is not formed. Thus, the non-magnetic ceramic area 16 is formed as the second ceramic area (FIG. 7C).

Thus, a third transfer sheet 18 according to this preferred embodiment of the present invention, in which the second green sheet 14 is supported by the supporting film 17, is prepared.

Figure 4D:
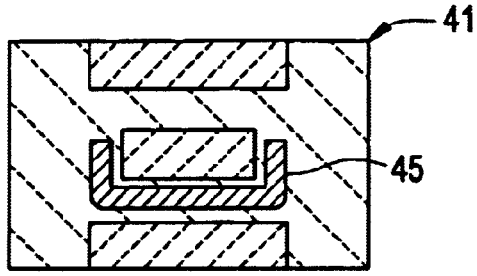
Figure 4B:
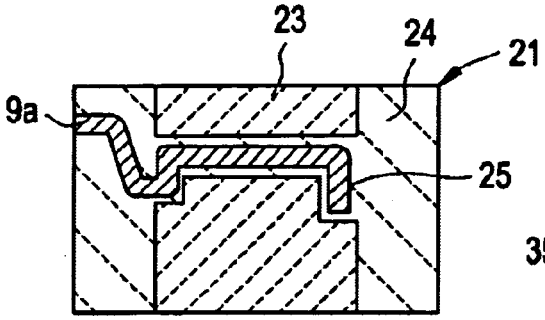
Figure 4E:
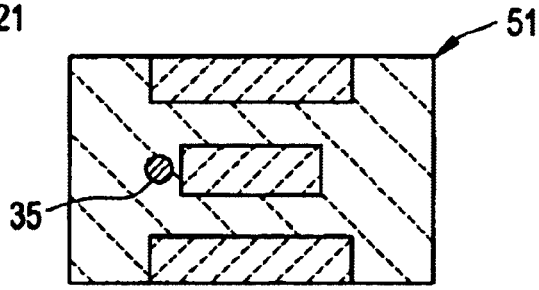
Figure 8A:
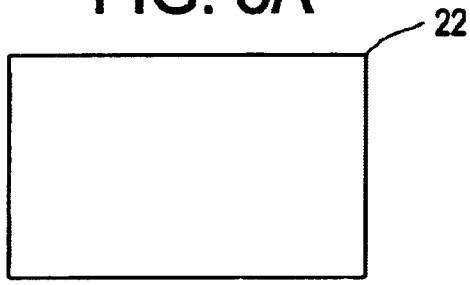
FIG. 8A to 8C are plan views illustrating a process of preparing a first transfer material according to the first preferred embodiment of the present invention.
Figure 8B:
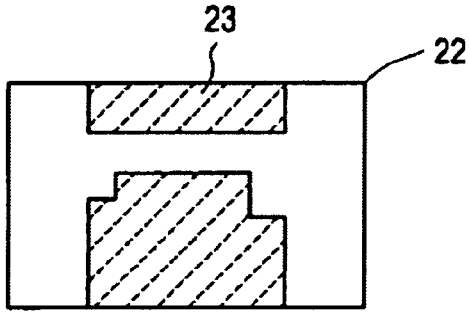
Figure 8C:
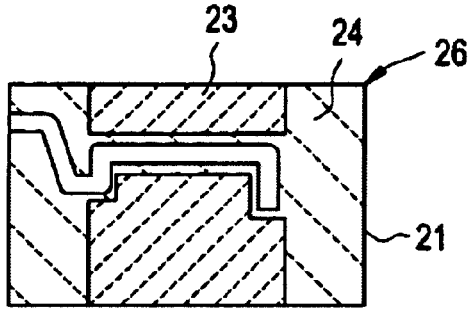
Figure 8D:
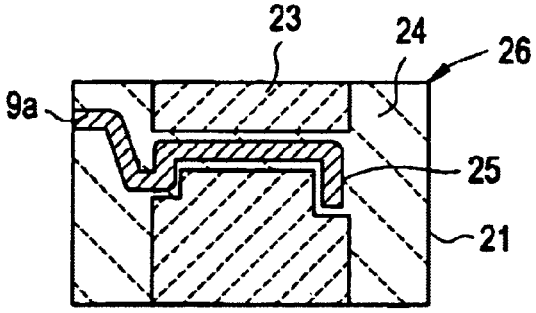

Similarly, a composite green sheet 21 as the first green sheet according to preferred embodiments of the present invention, shown in FIG. 4B, is formed. That is, a supporting film 22 made of a synthetic resin film, such as a polyethylene terephthalate film or other suitable material, shown in FIG. 8B, is prepared. Then, magnetic ceramic paste is screen-printed on the upper surface of the first supporting film 22 to form a magnetic ceramic area 23. Thereafter, non-magnetic ceramic paste is screen-printed on the upper surface of the supporting film 22 excluding the magnetic ceramic area 23 and the area where a conductor is to be printed, to form a non-magnetic ceramic area 24, as shown in FIG. 8C. Moreover, electrically conductive paste is screen-printed on the remaining area to form a conductor 25, as shown in FIG. 8D. The conductor 25 constitutes the upper end portion of the coil 9. The outer end of the conductor 25 constitutes a lead portion 9*a*.

In the composite green sheet 21, the conductor 25, the magnetic ceramic area 23, and the non-magnetic ceramic area 24 are formed so as not to overlap. Thus, the composite green sheet 21 is formed.

The first transfer sheet 26 shown in FIG. 8D is preferably formed as described above.

Figure 4C:
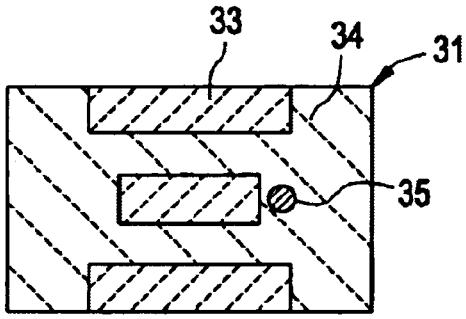
Figure 4F:
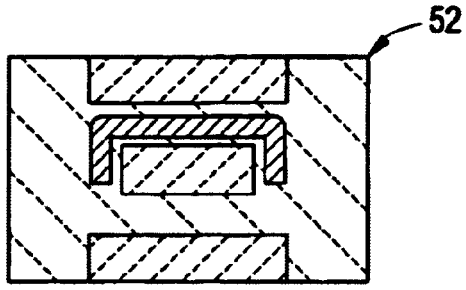

The first composite green sheet 31 shown in FIG. 4C is formed similarly to the composite green sheet 21 except that the shape of the conductor is different. That is, as shown in FIG. 4C, a via hole electrode 35 is formed as a conductor in the composite green sheet 31. A method of producing the composite green sheet 31 will be described with reference to FIGS. 9A to 9D.

Figure 9A:
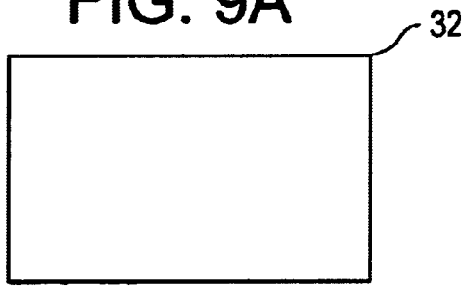
FIG. 9A to 9D are plan views illustrating a method of producing a composite green sheet having a via hole electrode which is prepared according to the first preferred embodiment of the present invention.
Figure 9B:
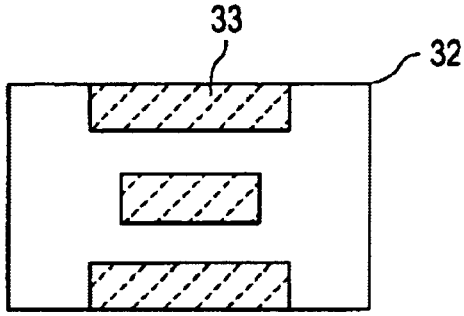
Figure 9C:
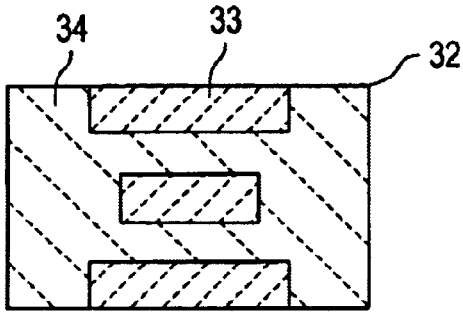
Figure 9D:
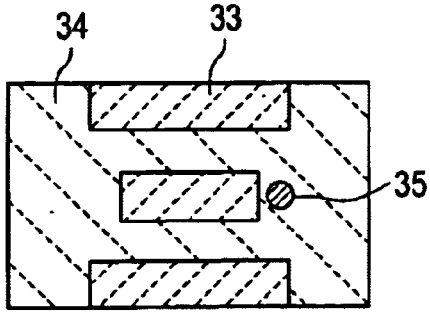

First, a first supporting film 32 is prepared (FIG. 9A). Then, magnetic ceramic paste is screen-printed onto the first supporting film 32 to form a magnetic ceramic area 33 (FIG. 9B). Moreover, non-magnetic ceramic paste is screen-printed onto the area of the first supporting film 32 excluding the magnetic ceramic area 33 to form a magnetic ceramic area 34, as shown in FIG. 9C. Next, a through-hole is formed via a laser or a punching process. Electrically conductive paste is filled into the through-hole to form a via hole 35 shown in FIG. 9D.

The via hole electrode 35 may be formed by printing the non-magnetic ceramic paste onto the area of the first supporting film 32 excluding the area where the via hole electrode 35 is to be formed. Thereafter, electrically conductive paste is filled into the area where the non-magnetic ceramic paste is not printed.

FIG. 4D shows the composite green sheet 41 which is laminated to the lower surface of the composite green sheet 31. The composite green sheet 41 is formed similarly to the composite green sheets 21 and 31 except that the shape of the conductor 45 is preferably different from those of the sheets 21 and 31. The conductor 45 is provided to constitute the winding portion of the coil 9.

Figure 10A:
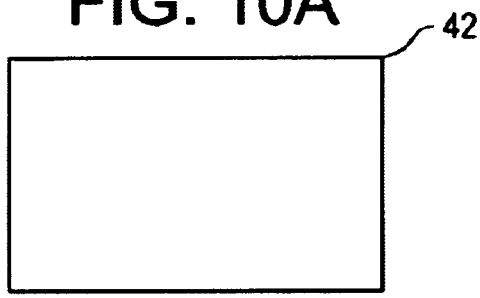
FIGS. 10A to 10C are plan views illustrating a process of preparing the first transfer sheet according to the first preferred embodiment of the present invention.
Figure 10B:
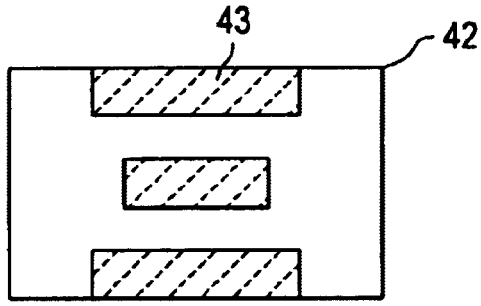
Figure 10C:
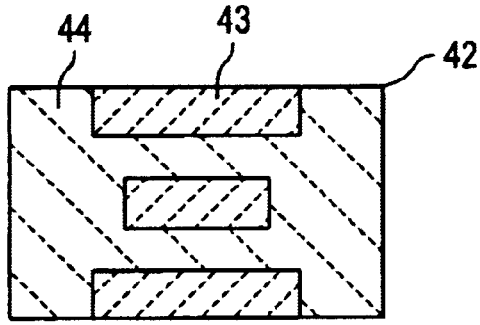
Figure 10D:
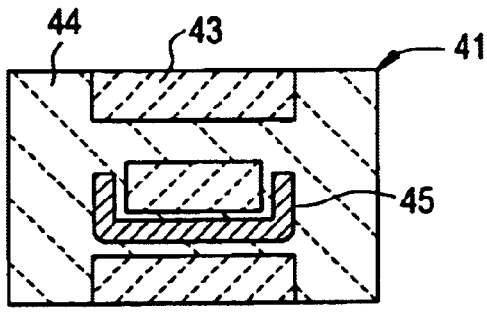

FIGS. 10A to 10D show a method of producing a composite green sheet 41. First, a first supporting film 42 is prepared (FIG. 10A). Magnetic ceramic paste is printed onto the upper surface of the first supporting film 42 to form a magnetic ceramic area 43 (FIG. 10B). Thereafter, non-magnetic ceramic paste is printed onto the area of the upper surface excluding the area where a conductor is to be formed to form a non-magnetic ceramic area 44. Eventually, electrically conductive paste is printed to form the conductor 45, as shown in FIG. 10D.

The conductor 45 is configured so as to be electrically connected to the via hole 35 shown in FIG. 4C after lamination. By the lamination, the via hole 35 is electrically connected to the conductor 25 of the composite green sheet 21 laminated to the upper surface thereof. That is, the via hole electrode 35 functions to electrically connect the upper and lower conductors 25 and 45 to each other.

A plurality of the first transfer sheets are prepared, in which the first composite green sheets 51 to 56 shown in FIGS. 4E and 4F, and FIGS. 5A to 5D are supported by the first supporting films, respectively.

The composite green sheets 51, 53, and 55 each have the via hole 35 as well as the composite green sheet 31. Moreover, the composite green sheets 52 and 54 are used to constitute the conductors in the winding portion of the coil 9. Accordingly, the number of turns in the coil 9 can be easily increased by repeating the lamination structure including the composite green sheet 52, the composite green sheet 53 having the via hole electrode formed therein, and the composite green sheet 54.

In the composite green sheet 56, the conductor 57 is provided to constitute the lower end portion of the coil 9, and the outer end of the conductor 57 constitutes the lower lead-out portion 9*b* of the coil 9.

Figure 5A:
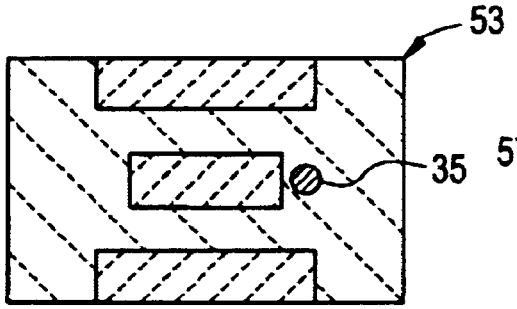
FIG. 5A to 5E are schematically plan views showing composite green sheets prepared to produce a laminated ceramic electronic component according to the first preferred embodiment of the present invention.
Figure 5D:
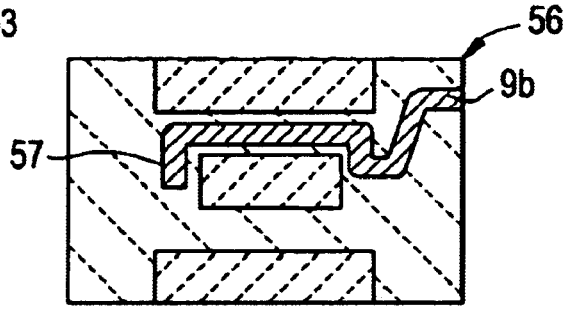
Figure 5B:
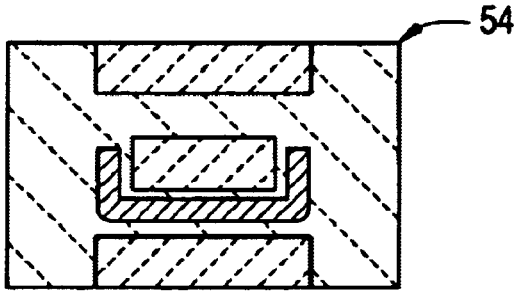
Figure 5E:
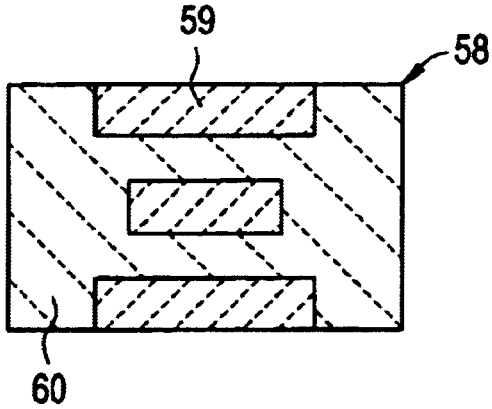
Figure 5C:
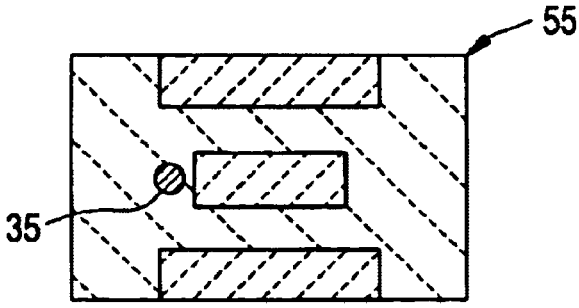

An appropriate number of the composite green sheets 58 shown in FIG. 5E are laminated to the lower surface of the composite green sheet 56. The composite green sheet 58 preferably includes a magnetic ceramic area 59 and a non-magnetic ceramic area 60. The composite green sheet 58 can be formed similarly to the composite green sheet 14. In this case, the non-magnetic ceramic area 60 is formed so as to overlap the non-magnetic ceramic area of the composite green sheet 56 on the upper surface thereof.

Moreover, composite green sheets 61 to 66 shown in FIG. 6A to 6F are laminated to the lower surface of the composite green sheet 58. The composite green sheets 61 to 66 form the first composite green sheets according to preferred embodiments of the present invention, and are laminated to form the portion of the electronic component 1 where the lower coil 10 is located. Accordingly, the composite green sheets 61 and 66 correspond to the upper and lower portions of the coils 10, respectively. The outer ends of the conductors 67 and 70 are led to the side edges of the composite green sheets 61 and 66, respectively, to constitute the lead out portions 10*a* and 10*b* of the coil 10. The composite green sheets 62 and 65 have via hole electrodes 35 for electrically connecting the conductors laminated to the upper and lower surfaces thereof, respectively. The composite green sheets 63 and 64 are configured similarly to the composite green sheets 41 and 52. Thus, the coil 10 having a desired number of turns can be obtained by repeating the structure including the composite green sheets 62 or 65 laminated between the composite green sheets 63 and 64.

Moreover, at least two ceramic green sheets 12 shown in FIG. 3B are laminated to the lower surface of the composite green sheet 66 to constitute the outer layer portion 2*d* (see FIG. 2)

The sintering body 2 of the laminated ceramic electronic component 1 of this preferred embodiment can be obtained by laminating the above-described sheets, pressing the formed laminate in the thickness direction, and thereafter, firing it.

Next, a method of laminating the above-described sheets will be described with reference to FIGS. 11 and 12.

Figure 11A:
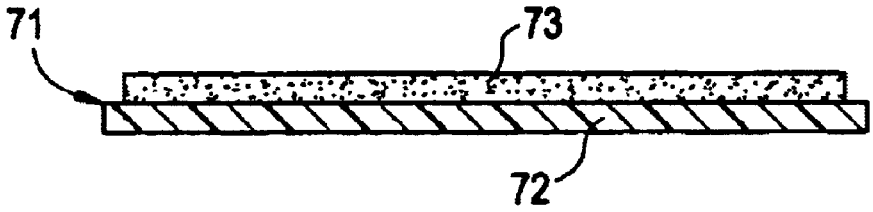
FIGS. 11A to 11C are cross sectional views illustrating processes of transferring a ceramic green sheet and a composite green sheet from the second transfer sheet and the first transfer sheet, respectively, according to the first preferred embodiment of the present invention.

A second transfer sheet 71 for forming the lower outer-layer portion is prepared as shown in FIG. 11A. In the transfer sheet 71, a substantially rectangular magnetic ceramic green sheet 73 is supported by a second supporting film 72.

Figure 11B:
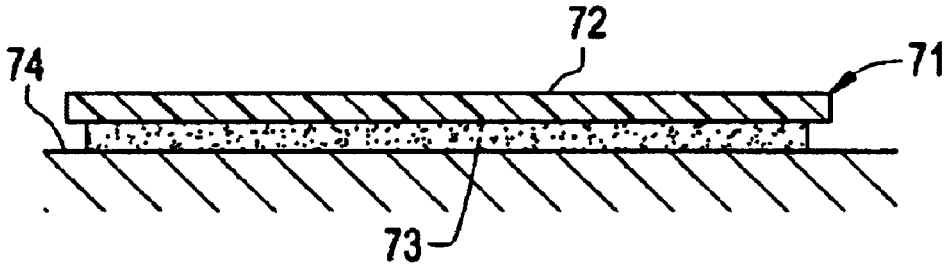

Next, the magnetic ceramic green sheet 73 of the second transfer sheet 71 is press-bonded to a flat lamination stage 74, as shown in FIG. 11B. Then, the supporting film 72 is released. In this manner, the magnetic green sheet 73 can be transferred from the transfer sheet 71 onto the lamination stage 74.

Figure 6A:
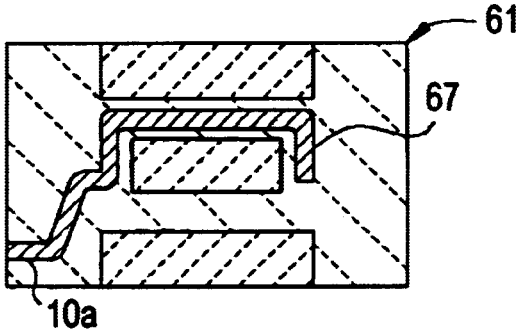
FIGS. 6A to 6F are plan views illustrating a method of producing the composite green sheet which is prepared according to the first preferred embodiment of the present invention.
Figure 6D:
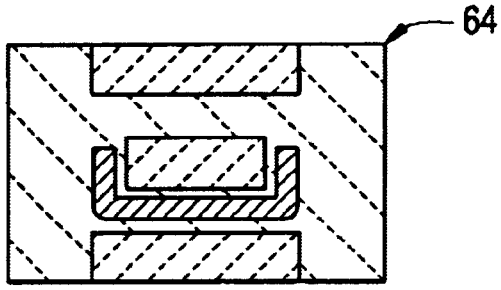
Figure 6B:
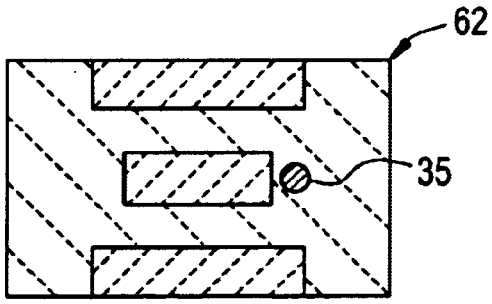
Figure 6E:
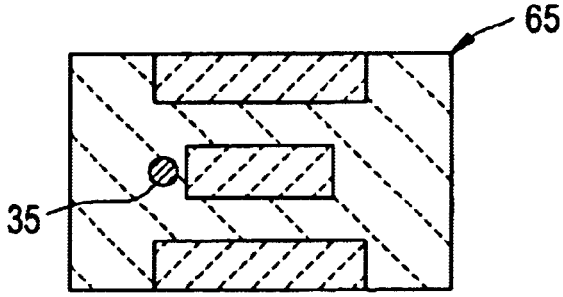
Figure 6C:
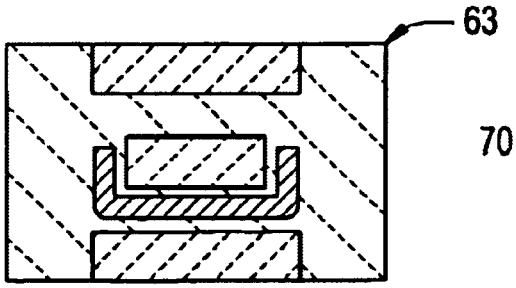
Figure 6F:
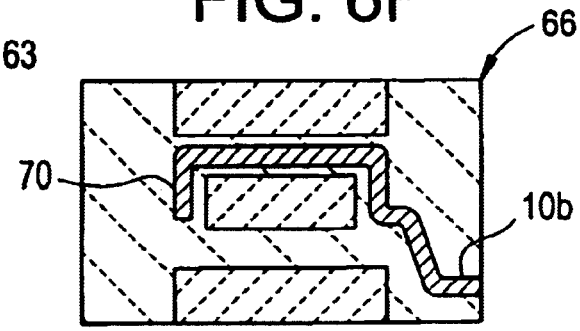
Figure 11C:
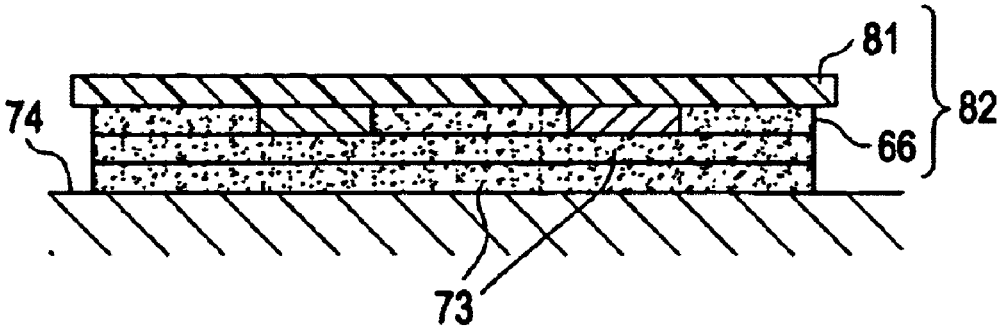

Next, the plurality of layers of the magnetic ceramic green sheets 73 are laminated by repeating the above-described process, as shown in FIG. 11C. Thereafter, similarly, the composite green sheet 66 shown in FIG. 6F is laminated by a transfer method. In this case, the composite green sheet 66 is supported by the supporting film 81, which constitutes the first transfer sheet 82. The composite green sheet 66 of this transfer sheet 82 is caused to contact under pressure with the magnetic ceramic green sheet 73 previously laminated, and thereafter, the supporting film 81 is released. The composite green sheet 66 is transferred from the transfer sheet 82.

Figure 12A:
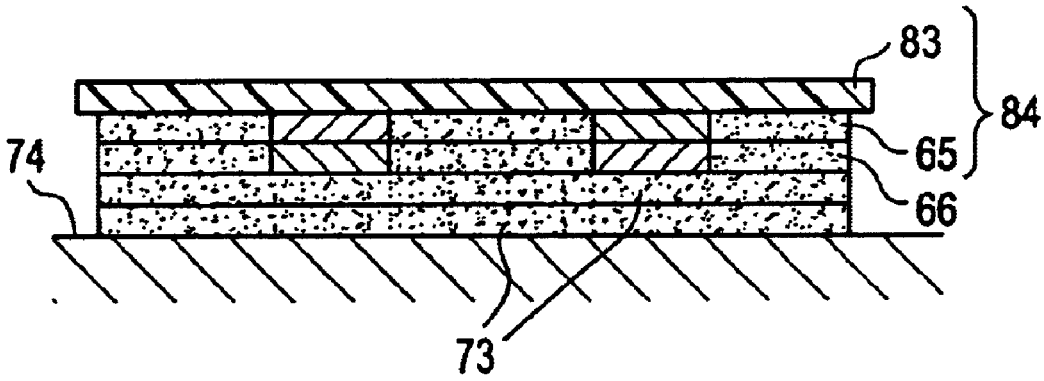
FIGS. 12A and 12B are cross sectional views illustrating a process of transferring the composite green sheet from the first transfer sheet according to the first preferred embodiment of the present invention.
Figure 12B:
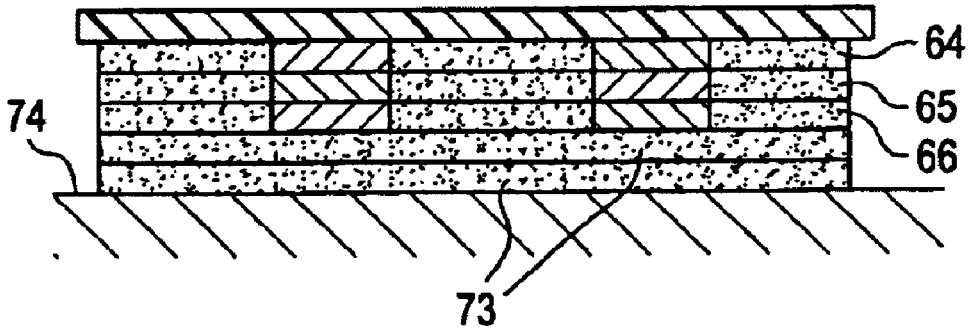

Similarly, the composite green sheet 65 is laminated by a transfer method, as shown in FIG. 12A. That is, the first transfer sheet 84 in which the composite green sheet 65 is supported by the supporting film 83 is prepared. The composite green sheet 65 of the first transfer sheet 84 is laminated onto the composite green sheet 66 which is previously laminated, and is bonded thereto under pressure. Thereafter, the supporting film 83 is released. Like this, the composite green sheet 65 is laminated by the transfer method. At this time, a portion of the non-magnetic area of the composite green sheet 65 is arranged on the conductor 70 corresponding thereto, and the via hole electrode 35 is connected to the conductor 70. Moreover, similarly, the green sheet 64 having the conductor is laminated by a transfer method, as shown in FIG. 12B. The conductor of the composite green sheet 64 is arranged on a portion of the non-magnetic area of the composite green sheet 65 corresponding thereto, and the via hole electrode 35 is connected to the conductor of the composite green sheet 64. Thus, the conductors of the composite green sheets 64 and 66 are arranged via the non-magnetic area of the composite green sheet 65. The conductors of the composite green sheets 64 and 66 are connected through the via hole electrode 35. A laminate from which the above-described sintered ceramic body 2 is formed can be obtained by the above-described processes.

That is, according to a preferred embodiment of the method of manufacturing a laminated ceramic electronic component 1, the first transfer step of laminating the magnetic ceramic green sheet supported by the second supporting film, the second transfer step of transferring the composite green sheet from the first transfer sheet having the structure in which the composite green sheet is laminated to the first supporting film, and the third transfer step of transferring the magnetic ceramic green sheet form the second transfer sheet in which the magnetic ceramic green sheet is supported by the second supporting film-are repeated, whereby a laminate from which the sintered ceramic body 2 is to be formed can be easily obtained.

Figure 13:
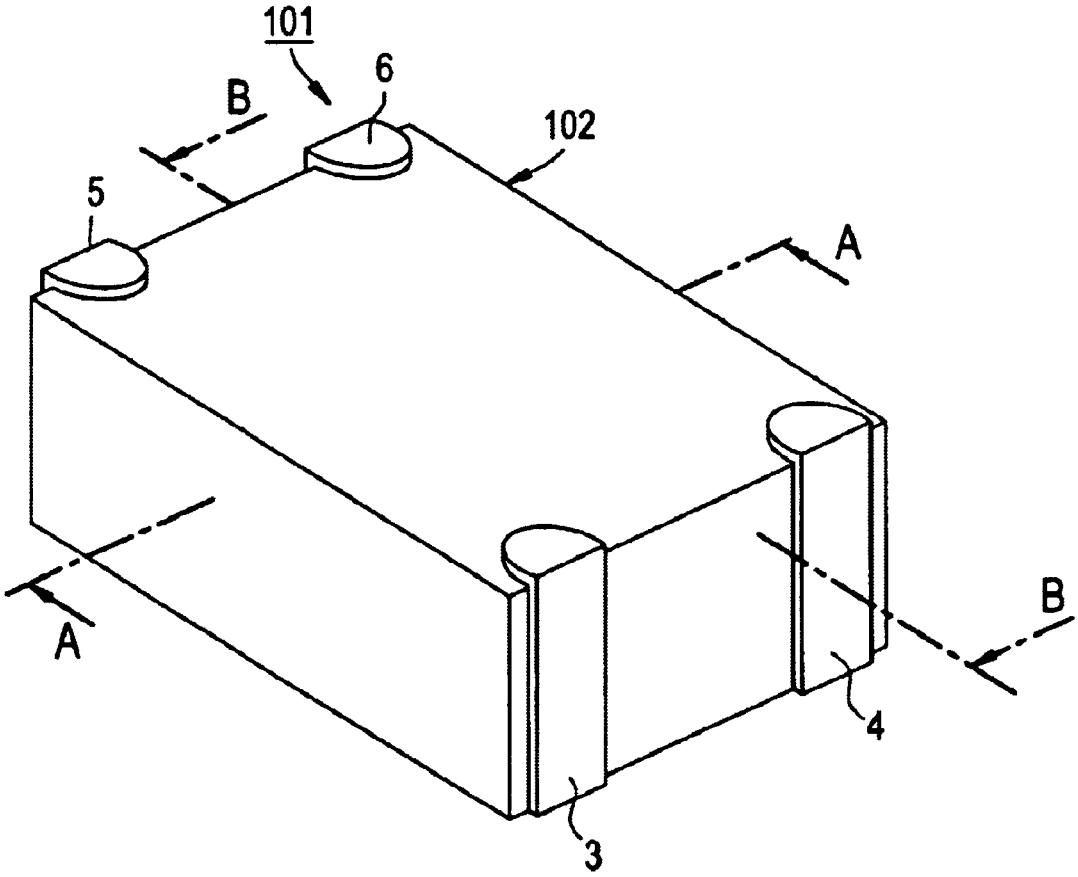
FIG. 13 is a perspective view of a laminated ceramic electronic component according to the second preferred embodiment of the present invention.
Figure 14A:
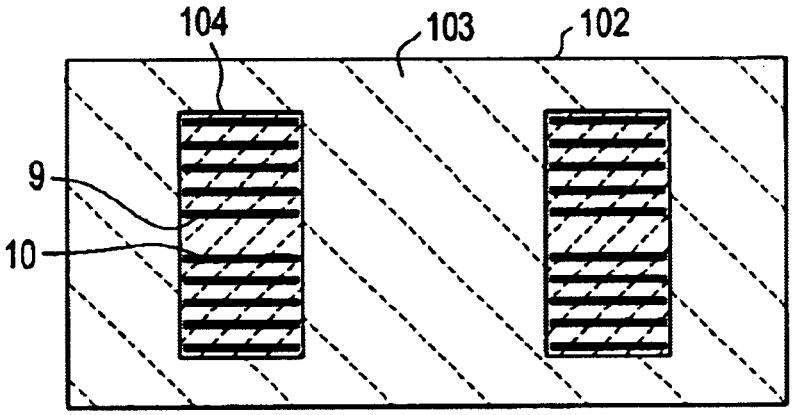
FIGS. 14A and 14B are respective cross sectional views taken along lines A—A and B—B in FIG. 10.
Figure 14B:
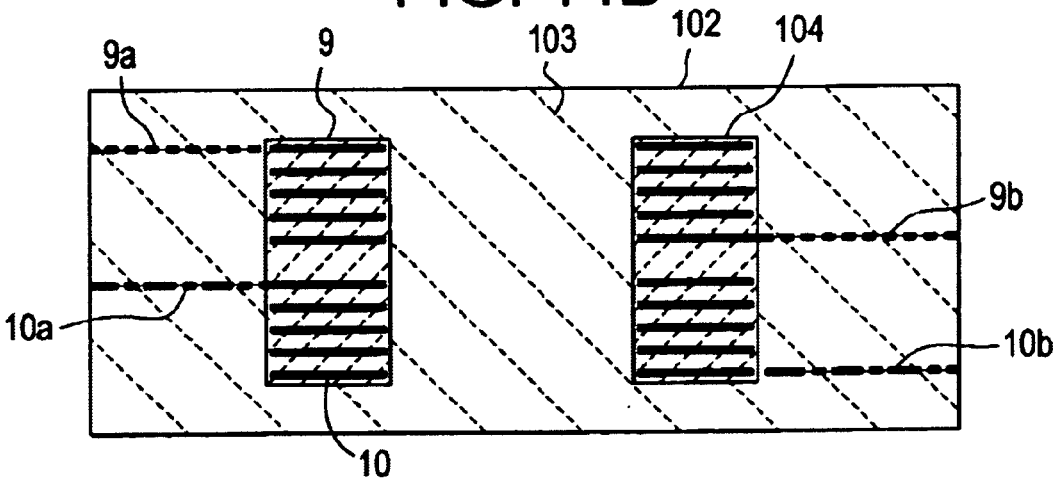

FIG. 13 is a perspective view of a chip laminated common mode choke coil defining a laminated ceramic electronic component according to a second preferred embodiment of the present invention. FIGS. 14A and 14B are cross sectional views taken along lines A—A and B—B in FIG. 13, respectively.

A laminated ceramic electronic component 101 preferably includes a sintered ceramic body 102. Also, in this preferred embodiment, the first and second coils 9 and 10 are located at the upper and lower surfaces thereof. The sintered ceramic body 102 preferably includes a magnetic ceramic 103 and a non-magnetic ceramic 104. Similarly to the sintered ceramic body 2, the winding portions of the coils 9 and 10 are disposed inside of the non-magnetic ceramics 104.

In the second preferred embodiment of the present invention, the non-magnetic ceramic 104 is formed so as to include the winding portions of the coils 9 and 10 only, excluding the lead-out portions 9*a,* 9*b,* 10*a,* and 10*b* of the coils 9 and 10. In other respects, the laminated ceramic electronic component 101 is the same as the laminated ceramic electronic component 1 of the first preferred embodiment of the present invention.

The sintered ceramic body 102 can be obtained by sintering the laminate including the respective sheets shown in FIGS. 15A to 15F and FIG. 16A and 16B which are laminated together.

Figure 15A:
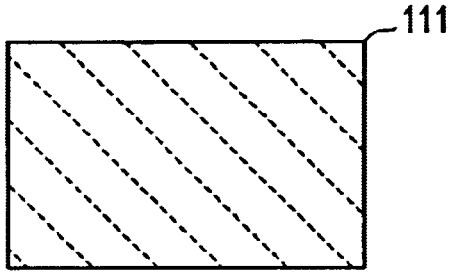
FIGS. 15A to 15F are plan views showing ceramic green sheets and composite green sheets which are to be laminated in the second preferred embodiment of the present invention.
Figure 15B:
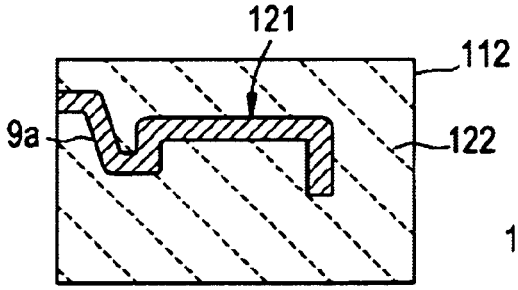
Figure 15E:
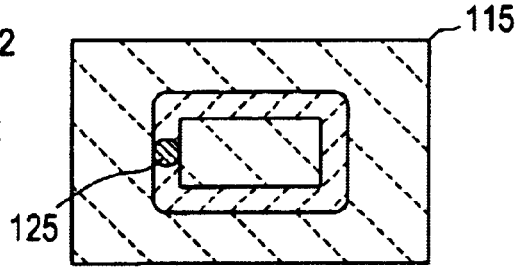

An appropriate number of substantially rectangular magnetic ceramic green sheets 111 shown in FIG. 15A are laminated to form the outer layer portions on the uppermost and lowermost surfaces of the laminate.

Figure 15C:
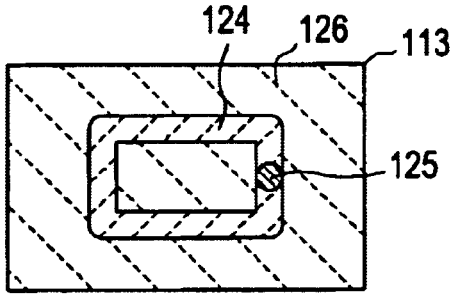
Figure 15F:
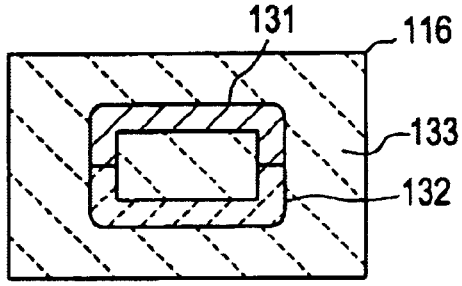
Figure 15D:
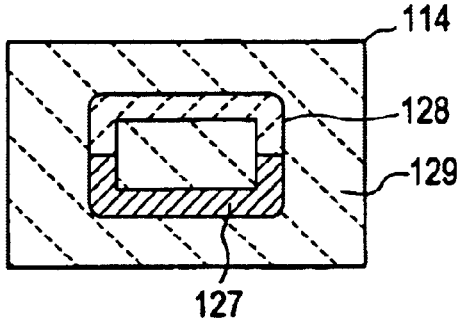
Figure 16A:
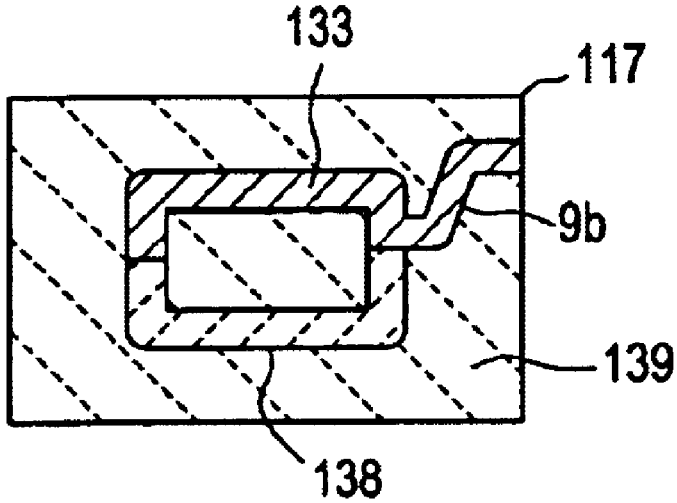
FIGS. 16A and 16B are plan views showing composite green sheets which are prepared according to the second preferred embodiment of the present invention.
Figure 16B:
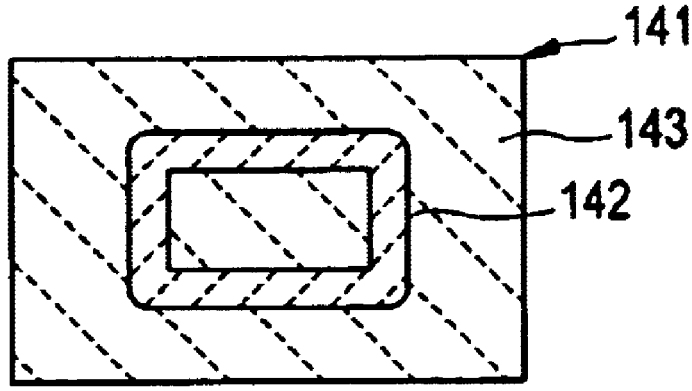
Figure 17A:
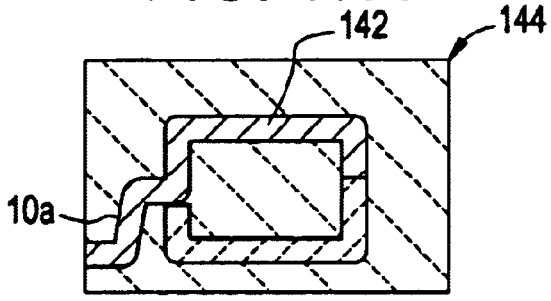
FIGS. 17A to 17D are plan views of composite green sheets which are used in a lamination portion for forming a second coil according to the second preferred embodiment of the present invention.
Figure 17B:
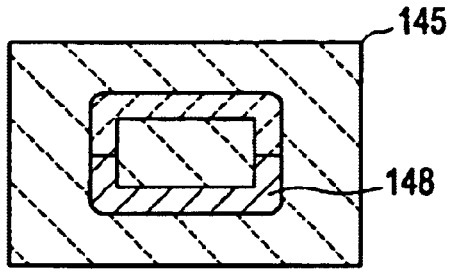
Figure 17C:
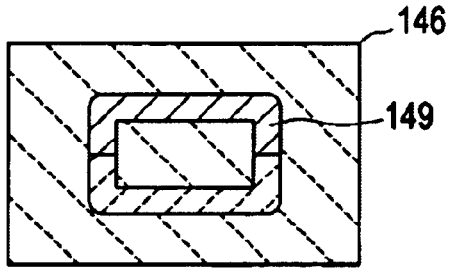
Figure 17D:
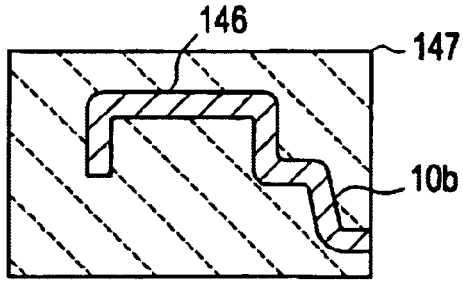

To form the upper coil 9, composite green sheets 112, 113, 114, 115, and 116 shown in FIGS. 15B to 15F, and a composite green sheet 117 shown in FIG. 16A are laminated in that order from the upper surface to the lower surface.

The composite green sheet 112 includes a magnetic ceramic area 122 and a conductor 121. That is, the conductor 121 constitutes the upper portion of the coil 9. The portion of the conductor 121 led to the outside constitutes the lead-out portion 9*a*. In this case, the conductor 121 is formed so as to avoid overlapping with the composite green sheet 112. That is, in the composite green sheet 112, the conductor 121 is formed in the area excluding the magnetic ceramic area 122.

In the composite green sheet 113, non-magnetic ceramic paste is printed onto a substantially rectangular frame area to form a non-magnetic ceramic area 124. A via hole electrode 125 defining a conductor is formed within the substantially rectangular frame-shaped non-magnetic ceramic area 124. The via hole electrode 125 is arranged so that the upper end of the via hole electrode 125 is electrically connected to the conductor 121 by the lamination. In addition, a magnetic ceramic area 126 is formed in the area excluding the substantially rectangular frame-shaped non-magnetic ceramic area 124.

The substantially rectangular frame-shaped area in FIG. 15C is shown correspondingly to the plan view of the winding portion of the coil 9.

In the composite green sheet 114 shown in FIG. 15D, a conductor 127 is formed in the area corresponding to one half of the turn of the substantially rectangular frame shape area. Non-magnetic ceramic paste is printed onto the area corresponding to the remaining one half of the turn to form a non-magnetic ceramic area 128. Then, the remaining area is a magnetic ceramic area 129 formed by printing. Thus, the conductor 127 constituting one half of the turn of the coil 9 is formed by using the composite green sheet 114.

The composite green sheet 115 includes a via hole 125 similarly to the composite green sheet 113. Moreover, the composite green sheet 116 includes a conductor constituting one half of the turn, a non-magnetic ceramic area 132 constituting one half of the turn, and a magnetic ceramic area 133.

Accordingly, a coil having a desired number of turns can be formed by repeating the lamination structure including the composite green sheets 114 to 116.

In a composite green sheet 117 shown in FIG. 16A, a conductor 133 for constituting the lower portion of the coil 9 is formed. The outer end of the conductor 133 constitutes the lead out portion 9*b* of the coil 9. In the substantially rectangular frame shaped area shown in the plan view of the coil 9, non-magnetic ceramic paste is printed onto the area constituting one half of the turn which is the area excluding the conductor 133 is provided, whereby a non-magnetic ceramic area is formed. Magnetic ceramic paste is printed onto the area excluding the conductor 133 and the non-magnetic ceramic area 138 to form a magnetic ceramic area 139.

To separate the coils 9 and 10 from each other, a composite green sheet 141 is laminated to the lower surface of the composite green sheet 117 as shown in FIG. 162. The composite green sheet 141 is configured similarly to the composite green sheet 113 except that the composite green sheet 141 excludes the via hole electrode 25. That is, the composite green sheet 141 includes a substantially rectangular frame-shaped non-magnetic ceramic area 142 and a magnetic ceramic area 143 that is the remaining area with respect to the area 142.

Composite green sheets 144 to 147 shown in FIGS. 17A to 17D, and a composite green sheet having a via hole, not specifically shown, are laminated to the lower surface of the composite green sheet 141. Thus, the portions of these sheets for forming the coil 10 are laminated.

The composite green sheets 144 and 147 are preferably configured similarly to the composite green sheets 112 and 117 used to form the coil 9. However, the lead-out portions 10*a* and 10*b* of the coil 10 are positioned so as to avoid overlapping the lead-out portions 9*a* and 9*b* of the coil 9.

In the coil 10, the composite green sheets 145 and 146 include conductors 148 and 149 for forming the coil conductor portion constituting one half of the turn, respectively. Thus, the composite green sheets 144 and 145 are configured similarly to the composite green sheets 114 and 116 used to form the coil 9. Also, in the portion where the coil 10 is formed, composite green sheets each having a via hole are laminated between the composite green sheets 144, 145, 146, and 147 to connect the upper and lower conductors.

An appropriate number of magnetic ceramic green sheets 111 are laminated to the lower surface of the composite green sheet 146, as described above.

A laminate is obtained by laminating the above-described composite green sheets by a transfer method similarly to the first preferred embodiment, and moreover laminating the magnetic ceramic green sheets 111 by a transfer method so that the magnetic ceramic green sheets 111 are arranged on the upper and lower surfaces. The obtained laminate is pressed in the thickness direction and fired, whereby the sintered ceramic body 102 according to the second preferred embodiment is obtained.

In the first and second preferred embodiments, the four external electrodes 3 to 6 are preferably disposed on the outer surface of the ceramic sintering bodies 2 and 102, respectively. At least six external electrodes 153 to 158 may be disposed on the outer surface of the sintered ceramic body 152. In this case, in the sintered ceramic body 152, three coils are formed in the thickness direction in a similar manner for the first or second preferred embodiment of the present invention.

In various preferred embodiments of the present invention, the number of coils and the number of inner electrodes arranged in the sintered ceramic body are not especially restricted.

Figure 18:
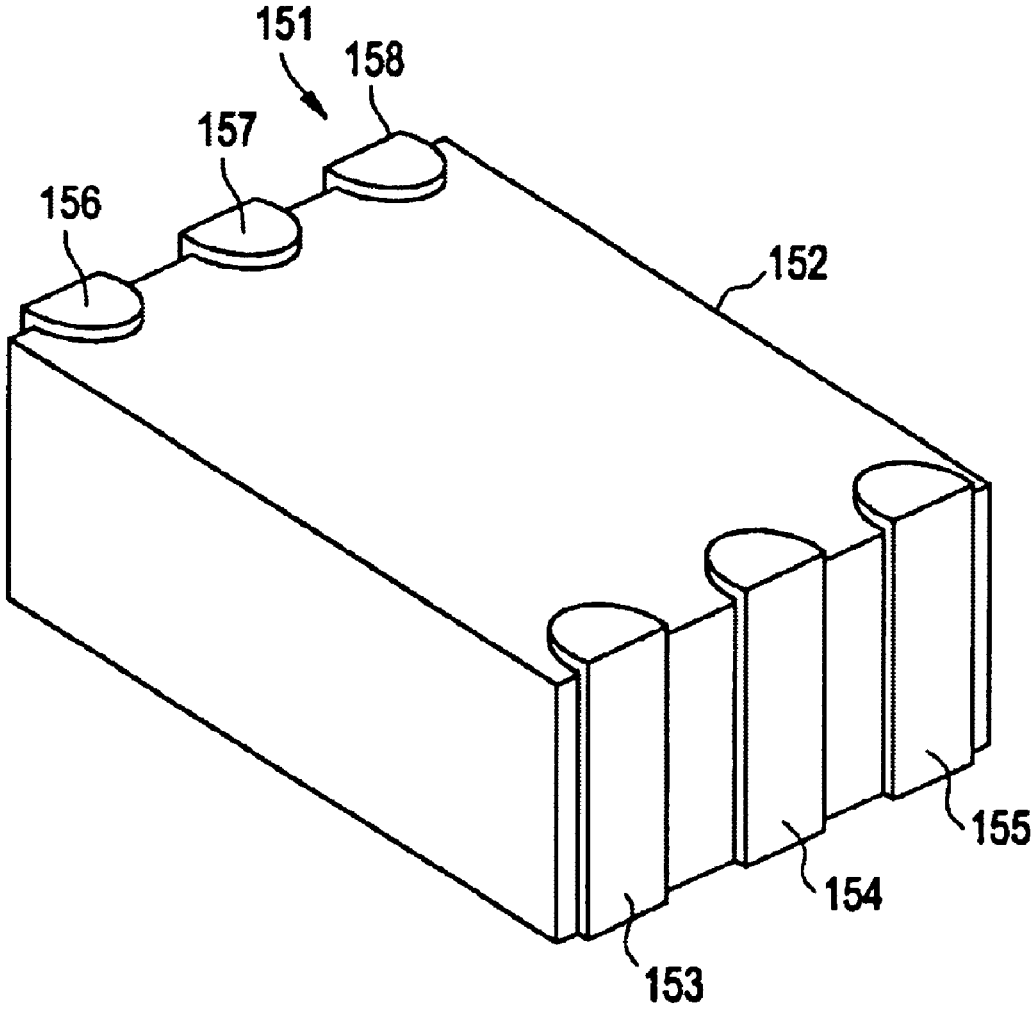
FIG. 18 is a perspective views showing the appearance of a laminated ceramic electronic component according to a modified preferred embodiment of the present invention.
Figure 19:
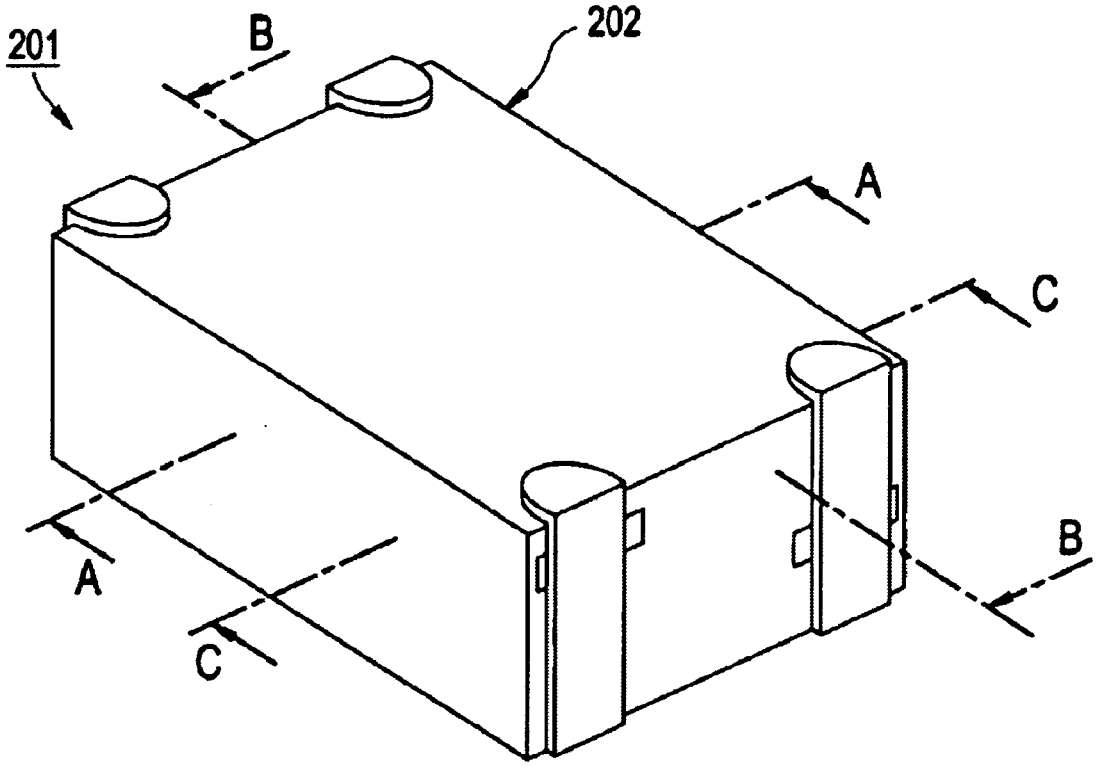
FIG. 19 is a perspective view showing the appearance of a laminated ceramic electronic component according to the third preferred embodiment of the present invention.
Figure 20A:
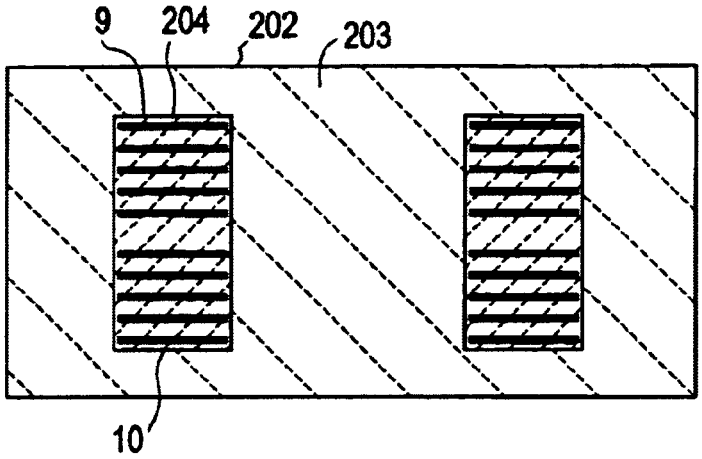
FIGS. 20A to 20C are cross sectional views taken along lines A—A, B—B, and C—C, respectively.
Figure 20B:
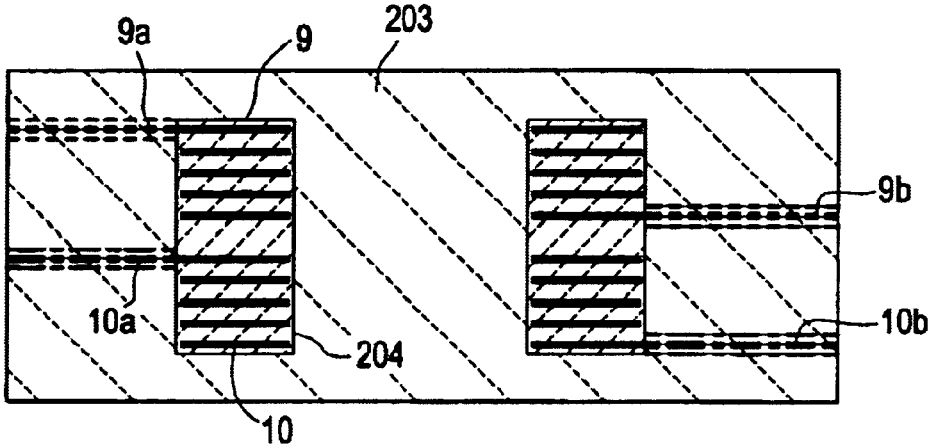
Figure 20C:
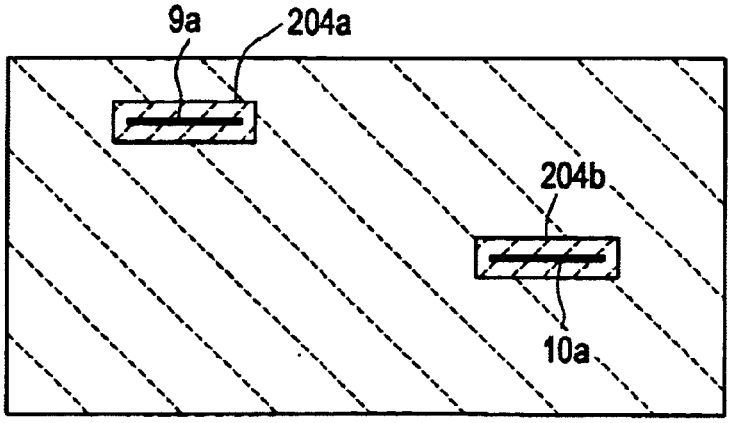

FIG. 19 shows the appearance of a laminated ceramic electronic component according to a third preferred embodiment of the present invention. FIGS. 20A to 20C are cross sectional views taken along lines A—A, B—B, and C—C in FIG. 18. In the laminated ceramic electronic component 201 of the third preferred embodiment, a laminated sintered ceramic body 202 preferably includes a magnetic ceramic 203 and a non-magnetic ceramic 204, similarly to the first and second preferred embodiments. Similarly, the first and second coils 9 and 10 are formed in the sintered ceramic body 202. The area made of the magnetic ceramic 204 is different from that of the second preferred embodiment of the present invention. That is, in the laminated ceramic electronic component 1 of the second preferred embodiment, no non-magnetic ceramic layers are formed on the upper and lower surfaces of each of the lead-out portions 9*a*, 9*b*, 10*a*, and 10*b* of the coils 9 and 10. In the third preferred embodiment, the coil conductors 9 and 10 include winding portions, and the first and second lead-out portions 9*a*, 9*b*, 10*a*, and 10*b* connected to the winding portions, respectively. The peripheries of the lead-out portions 9*a*, 9*b*, 10*a*, and 10*b* are made of non-magnetic ceramic layers 204*a* and 204*b*. In other respects, the first preferred embodiment is similar to the second preferred embodiment. Therefore, similar elements in the second and third preferred embodiments are designated by the same reference numerals, and repetitious description is omitted.

The normal impedance can be reduced by coating the coil lead-out portions 9*a*, 9*b*, 10*a*, and 10*b* in the peripheries thereof with the non-magnetic ceramic layers 204*a* and 204*b*.

Also, in the first preferred embodiment, the peripheries of the coil lead-out portions 9*a*, 9*b*, 10*a*, and 10*b* are preferably made of the non-magnetic ceramics. Accordingly, the normal impedance can be reduced similarly to the third preferred embodiment of the present invention.

Figure 21:
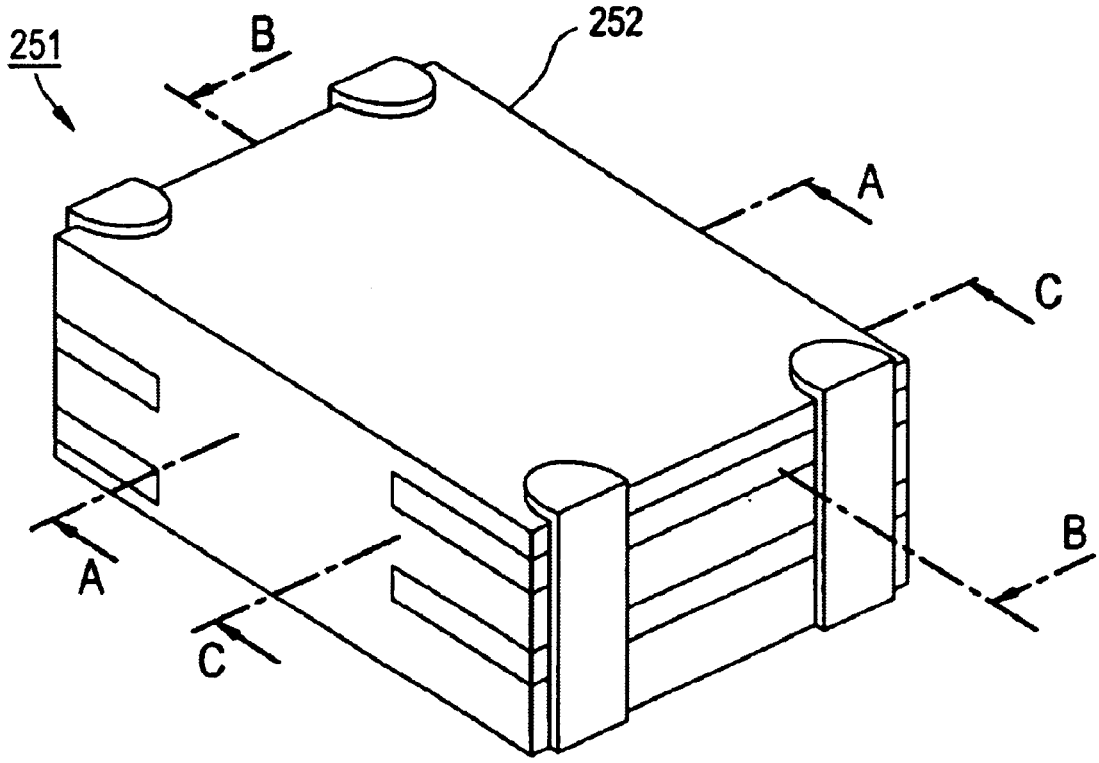
FIG. 21 is a perspective view of a laminated ceramic electronic component according to a fourth preferred embodiment of the present invention.
Figure 22A:
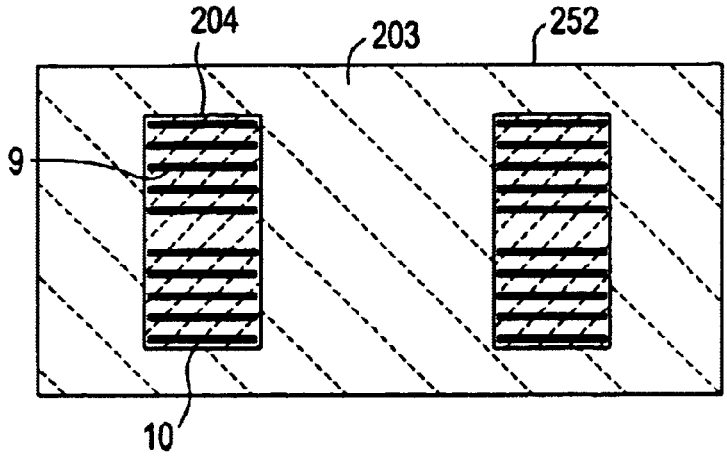
FIGS. 22A to 22C are cross sectional views along lines A—A, B—B, and C—C in FIG. 20.
Figure 22B:
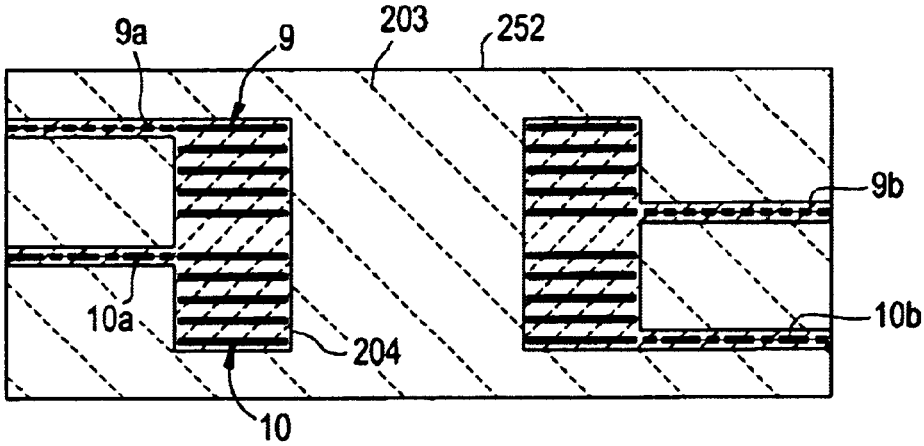
Figure 22C:
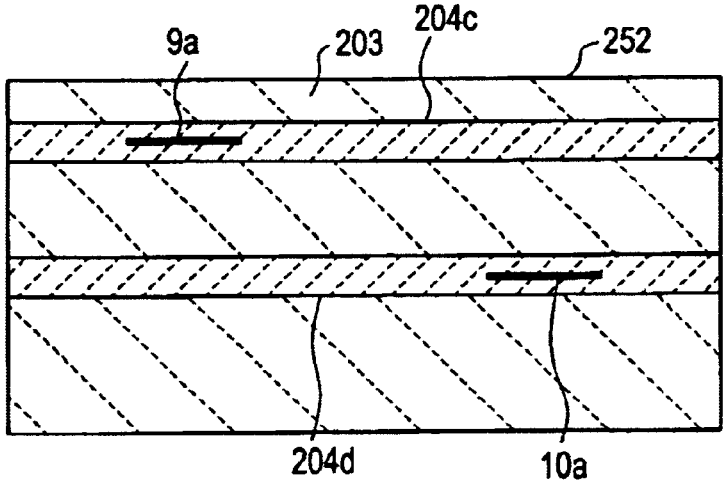

FIG. 21 is a perspective view of a laminated ceramic electronic component according to a fourth preferred embodiment of the present invention. FIGS. 22A to 22C are cross sectional views taken along lines A—A, B—B, and C—C in FIG. 21.

In a laminated ceramic electronic component 251 of a fourth preferred embodiment, the peripheries of the lead out portions 9*a*, 9*b*, 10*a*, and 10*b* of the coils 9 and 10 are preferably made of non-magnetic ceramic layers 204*c* and 204*d*. The fourth preferred embodiment is different from the third preferred embodiment in that the peripheries of the non-magnetic ceramic layers 204*c* and 204*d* surrounding the coil lead-out portions 9*a* and 10*a* are arranged so as to extend from one end surface to the other end surface in the width direction, at heights in the sintered ceramic body 252. In the third preferred embodiment, only the peripheries of the coil lead out portions 9*a* and 10*a*are composed of the non-magnetic ceramic layers 204*a* and 204*b*. On the other hand, in the fourth preferred embodiment, the non-magnetic ceramic layers 204*c* and 204*d* are formed in the coil lead out portions so as to extend from the one surface to the other surface of the sintered ceramic body 252.

Figure 23:
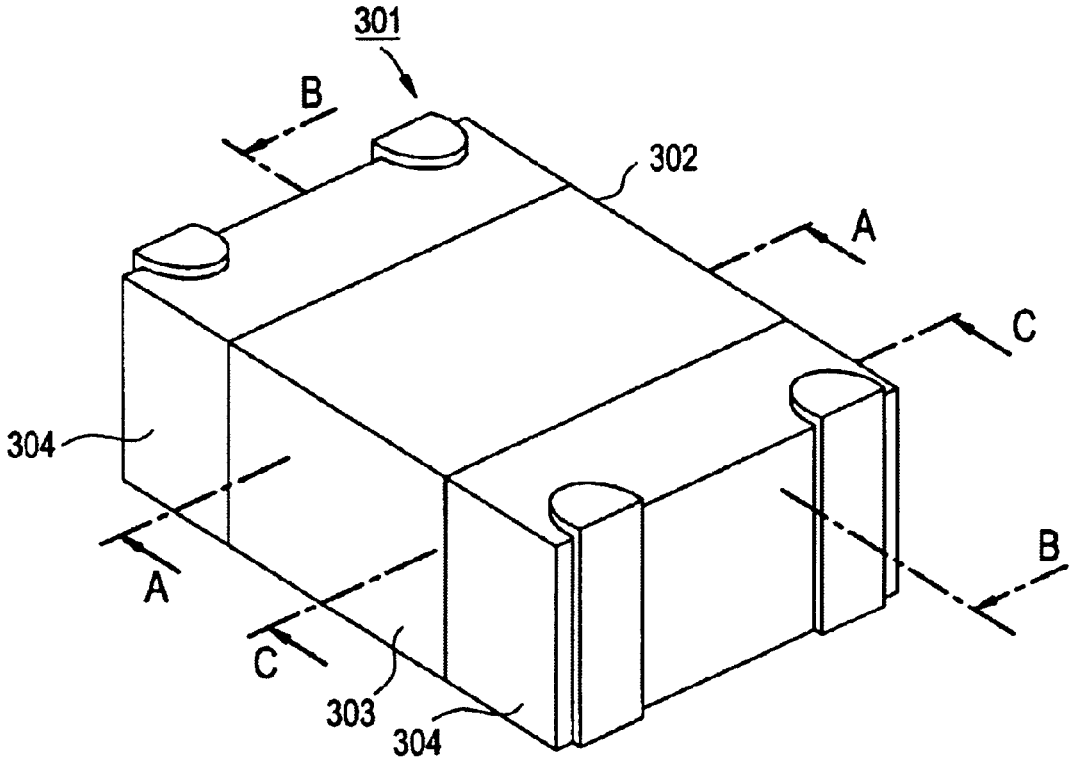
FIG. 23 is a perspective view of a laminated ceramic electronic component according to a fifth preferred embodiment of the present invention.
Figure 24A:
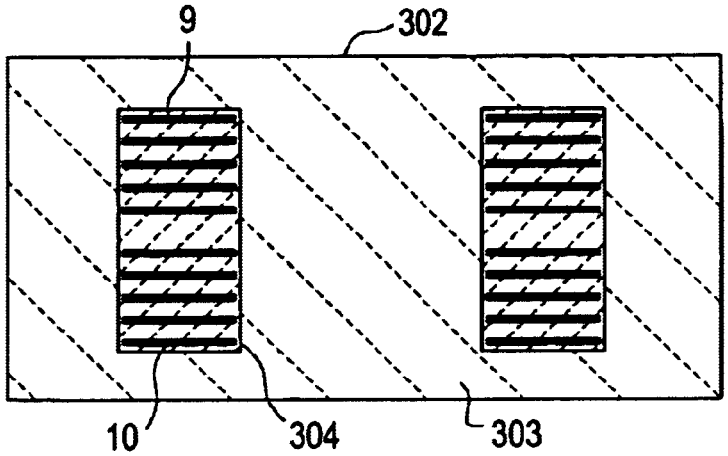
FIGS. 24A, 24B, and 24C are cross sectional views taken along lines A—A, B—B, and C—C in FIG. 23.
Figure 24B:
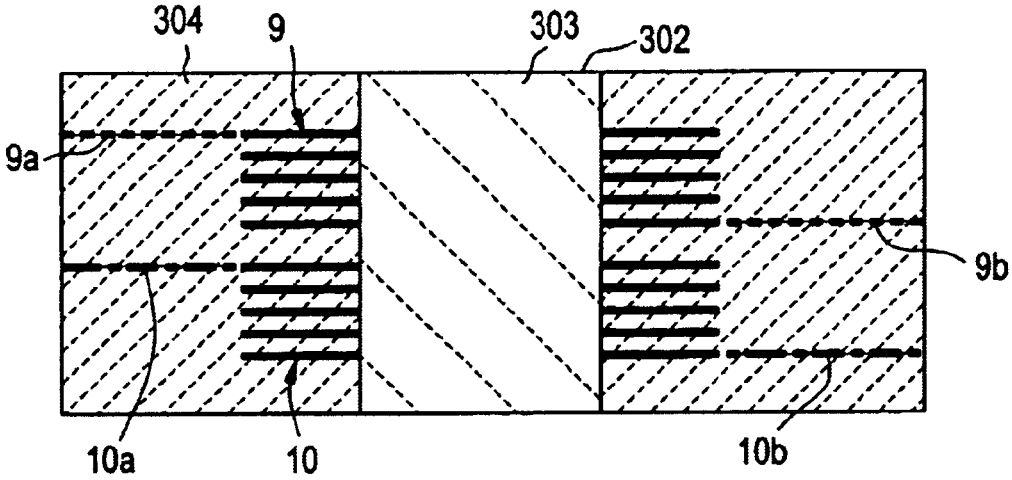
Figure 24C:
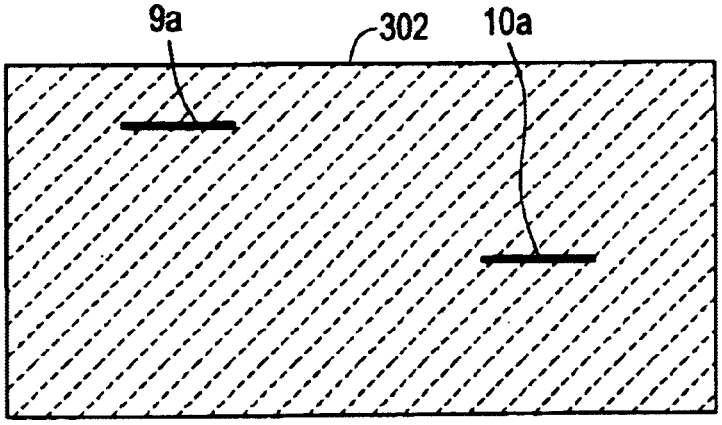

FIG. 23 is a perspective view of a laminated ceramic electronic component according to a fifth preferred embodiment of the present invention. FIGS. 24A to 24C are cross sectional views taken along lines A—A, B—B, and C—C in FIG. 23.

In a laminated ceramic electronic component 301 according to the fifth preferred embodiment, a sintered ceramic body 302 includes a magnetic ceramic 303 and a non-magnetic ceramic 304, as shown in FIG. 24A. The non-magnetic ceramic 304 further extends outside of the winding portions of the coils 9 and 10 in the length direction passing both of the end surfaces of the ceramic sintering 302. That is, the magnetic ceramic 303 is provided in the approximate center of the sintered ceramic body 302. The non-magnetic ceramic 304 is arranged on both surfaces in the length direction of the sintered body 302. Moreover, the non-magnetic ceramic 304 extends along the approximate center in the length direction to reach the winding portions of the coils 9 and 10 in the area where the magnetic ceramic is provided. Accordingly, the lead out portions 9*a*, 10*a*, 9*b*, and 10*b* of the coils 9 and 10 are surrounded by the non-magnetic ceramic 304. The area extending along the length direction of the sintered ceramic body 302 is preferably made of the non-magnetic ceramic 304. In other respects, the fifth preferred embodiment is similar to the second preferred embodiment.

Also, in the laminated ceramic electronic component 301 of the fifth preferred embodiment, the non-magnetic ceramic 304 is arranged in the peripheries of the lead-out portions 9*a*, 10*a*, and 10*b* of the coils 9 and 10. Thus, improvement of the high frequency characteristics and reduction of the impedance are achieved.

Figure 25:
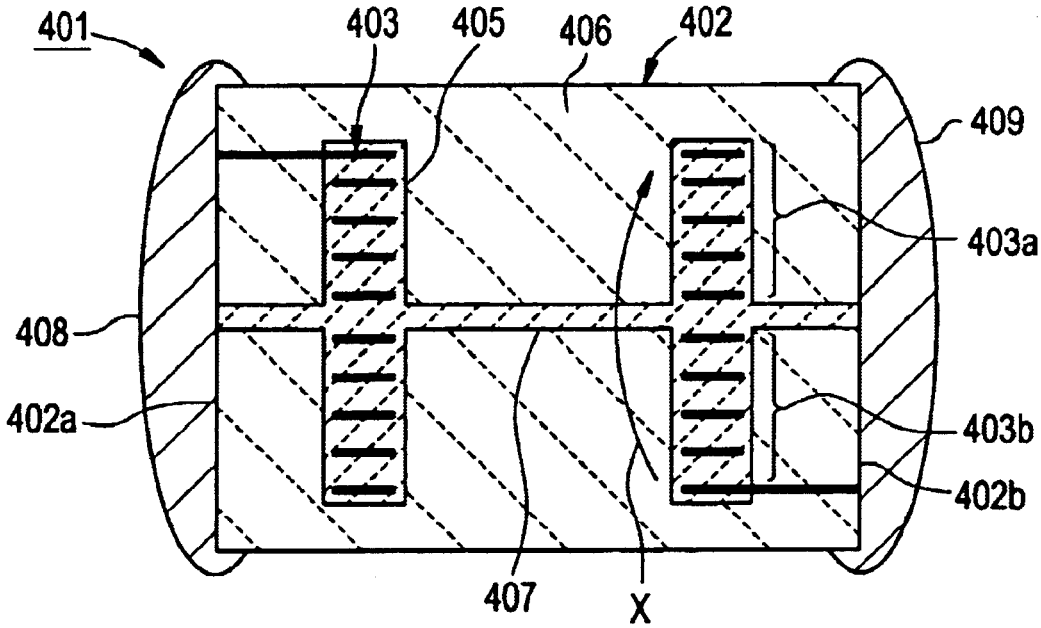
FIG. 25 is a longitudinal cross sectional view of a laminated ceramic electronic component according to a sixth preferred embodiment of the present invention.

FIG. 25 is a longitudinal cross sectional view of a laminated ceramic electronic component according to a sixth preferred embodiment of the present invention.

In the laminated ceramic electronic component 401, the first and second coils 9 and 10 are formed in a sintered ceramic body 402. One coil 403 is formed in the sintered ceramic body 402 in the laminated ceramic electronic component 401. The upper end of the coil 403 is led to the end surface 402*a* of the sintered ceramic body 402. The lower end is led to the other end surface 402*b*. The periphery of the coil 403 is preferably made of a non-magnetic ceramic 405 similarly to the first to fifth preferred embodiments. The other portion of the sintered ceramic body 402 is preferably made of a magnetic ceramic 406. Moreover, a non-magnetic ceramic layer 407 is arranged so as to extend between the upper portion 403*a* and the lower portion 403*b* of the coil 403, from one end surface to the other end surface of the sintered ceramic body 402, at a certain height thereof.

Reference numerals 408 and 409 designate external electrodes. The external electrodes 408 and 409 are arranged so as to cover the end faces 402*a* and 402*b*, respectively, and are electrically connected to the upper and lower ends of the coil conductor 403. The laminated ceramic electronic component 401 of this preferred embodiment can be obtained by laminating composite green sheets by a transfer method, laminating magnetic green sheets to the upper and lower surfaces, and firing the obtained laminate. Accordingly, similarly to the laminated ceramic electronic component 1 of the first preferred embodiment, the laminated ceramic electronic component 401 of this preferred embodiment can be produced inexpensively by a relatively simple process compared to that for a conventional laminated inductor. Moreover, the accuracy of printing conductive paste is greatly improved since the base that is the upper surface of a composite green sheet is flat.

Moreover, in the laminated ceramic electronic component 401 of this preferred embodiment, the non-magnetic ceramic layer 407 is disposed between the upper portion 403*a* and the lower portion 403*b* of the coil 403. Thus, the electronic part 401 acts as an open magnetic circuit structure inductor. Accordingly, generation of a magnetic flux between the upper portion 403*a* and the lower portion 403*b* is minimized. Thus, a laminated inductor in which the current superposition characteristics are high, and reduction of the inductance can be suppressed can be provided.

Figure 26:
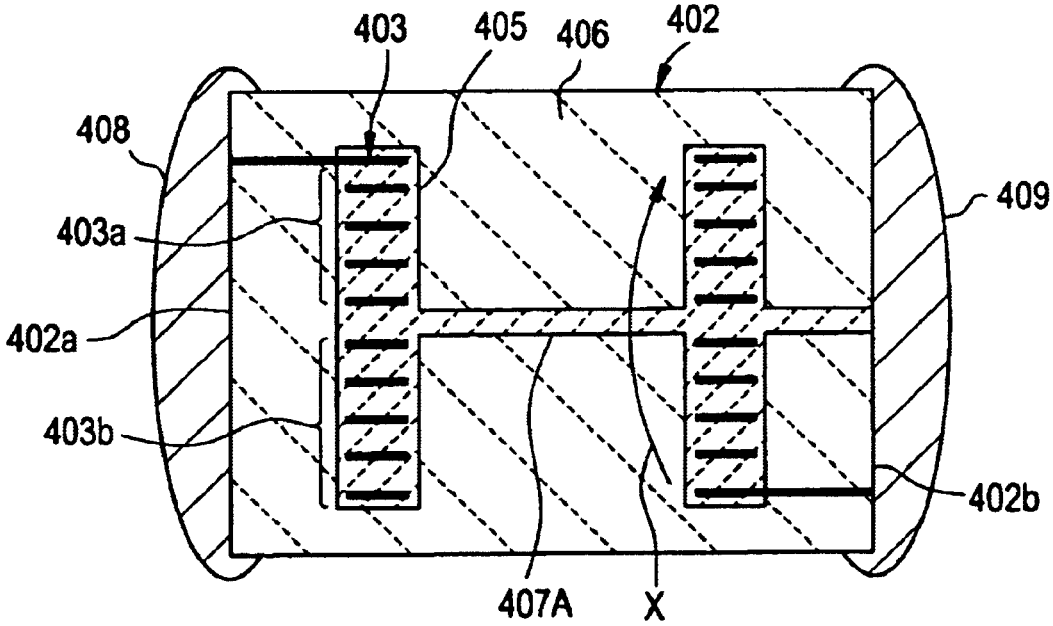
FIG. 26 is a longitudinal cross sectional view showing a modification of the laminated inductor shown in FIG. 25.

FIG. 26 is a longitudinal cross sectional view showing a modification of the laminated inductor 401 shown in FIG. 25. In the laminated inductor 401, the non-magnetic ceramic layer 407 is arranged so as to extend from one end surface to the other end surface at a middle height of the sintered ceramic body 402. The non-magnetic ceramic layer 407A may be arranged so as to extend inside of the winding portions of the coil 403 as shown in FIG. 26. In this case, the modification of the laminated inductor 401 is an open magnetic circuit structure inductor.

Figure 27:
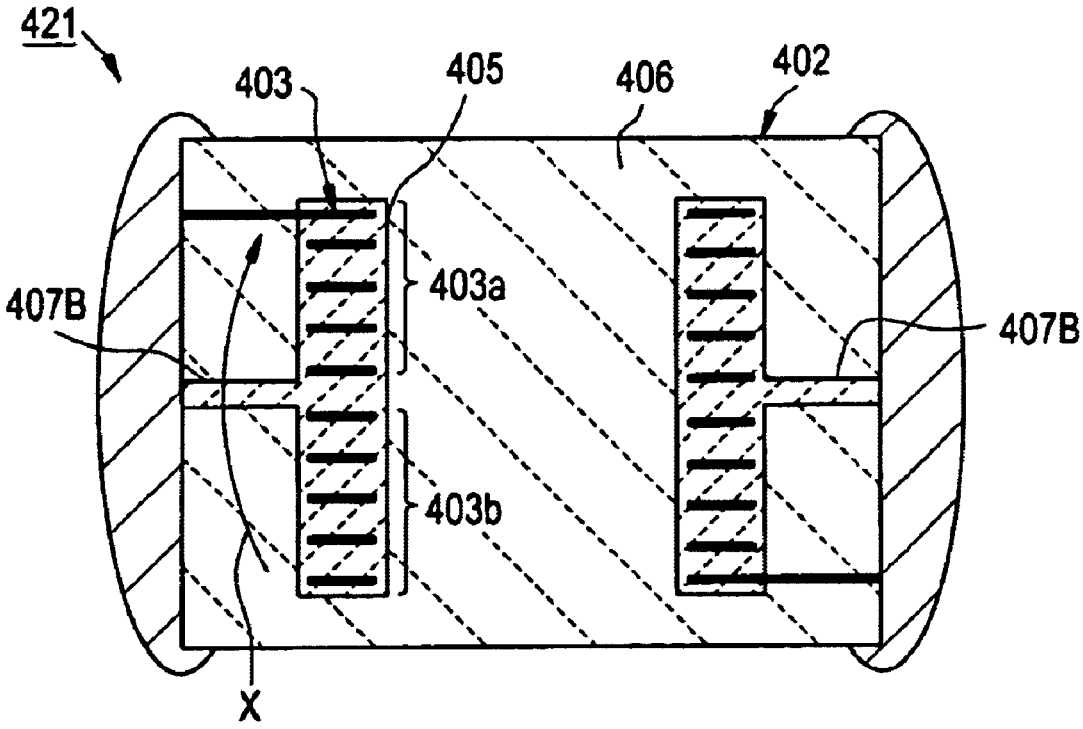
FIG. 27 is a longitudinal cross sectional view showing another modification of the laminated inductor shown in FIG. 26.

FIG. 27 is a longitudinal cross sectional view showing another modification of the laminated inductor 401.

In a laminated inductor 421 shown in FIG. 27, the non-magnetic ceramic layer 407B are formed outside the winding portions of the coils 403. Also, in the case, another modification of the laminated inductor 401 is an open magnetic circuit structure inductor.

That is, to suppress a large magnetic flux through the upper coil portion 403*a* and the lower coil portion 403*b*, a non-magnetic ceramic layer may be formed in a position where the magnetic flux is interrupted, as shown by the non-magnetic ceramic layers 407, 407A, and 407B. The non-magnetic ceramic layer is not restricted to the positions shown in the preferred embodiments and modifications thereof.

According to the method of manufacturing a laminated ceramic electronic component of preferred embodiments of the present invention, the first and second transfer sheets are prepared, and the first, second, and third transfer processes are carried out,.whereby a laminate is obtained. Accordingly, the process can be simplified compared to a conventional printing lamination process in which printing is repeated. Thus, the cost of the laminated ceramic electronic component can be reduced.

Moreover, according to the conventional printing lamination process, in printing, blurring occurs, and irregularities in characteristics are caused, since the flatness of a base is insufficient. According to preferred embodiments of the present invention, the bases on which the conductors are to be printed are flat, and moreover, the composite green sheets and the ceramic green sheets are laminated by the transfer method. Thus, laminated ceramic electronic components in which the irregularities in characteristics are small, and the reliability is high can be provided.

In the case in which the via hole electrode is formed in the composite green sheet of at least one first transfer sheet so that the conductors of composite green sheets are connected, a plurality of the conductors are electrically connected to each other through the via hole electrode. Thus, for example, coil conductors which function as an inductance element can be easily formed.

In the case in which the first ceramic area is made of the magnetic ceramic, and the second ceramic area is made of non-magnetic ceramic, an open magnetic circuit structure laminated coil can be easily provided by forming a conductor constituting a coil, for example, in the non-magnetic ceramic portion.

When the ceramic green sheet is used as the second transfer material, the outer layer portions on the upper and lower surfaces of the laminated ceramic electronic component can be formed by using magnetic ceramic.

In the case in which the magnetic ceramic area and the non-magnetic ceramic area are formed by printing magnetic ceramic paste and non-magnetic ceramic paste, overlapping of both of the ceramic areas is avoided. Accordingly, the composite ceramic green sheet of which the upper surface is flat can be easily obtained.

When the composite green sheet is formed, the first and second ceramic areas are formed so as not to include the portion where the via hole electrode is to be formed, and the electrically conductive paste is filled into the via hole electrode portion. In this case, the via hole electrode having a high reliability of electrical connection can be formed.

When the via hole electrode is formed by forming a through-hole in the portion where the via hole electrode is to be formed, and filling electrically conductive paste into the through-hole, after the composite green sheet is formed, the via hole electrode forming process can be simplified.

Preferably, when a third transfer sheet is prepared in which a second composite green sheet having a magnetic ceramic area and a non-magnetic ceramic area is supported by a third supporting film. In this case, the magnetic and non-magnetic ceramic areas can be formed so as to contact the upper and lower surfaces of the conductor of a coil or other element.

The laminated ceramic electronic component of preferred embodiments of the present invention can be produced by the method of manufacturing a laminated ceramic electronic component of the present invention. Accordingly, the laminated ceramic electronic component has the first ceramic area and the second ceramic area formed in the sintered ceramic body. Laminated ceramic electronic components having different functions, such as a laminated coil having an open magnetic circuit structure, can be easily provided.

In the laminated ceramic electronic component of preferred embodiments of the present invention, not only the coil conductor winding portion but also the first lead out portions are preferably coated with the non-magnetic ceramic. Therefore, when the electronic component is used as a laminated inductor, for example, the normal impedance is greatly reduced.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A method of manufacturing a laminated ceramic electronic component comprising the steps of:

preparing a first transfer sheet including a composite green sheet supported by a first supporting film, said composite green sheet including a conductor formed on a region of the first transfer sheet and at least one of a first ceramic area and a second ceramic area formed on another region of the first transfer sheet excluding a the region of the transfer sheet where the conductor is formed such that the conductor and the at least one of the first ceramic area and the second ceramic area do not overlap each other;

preparing a second transfer sheet including a ceramic green sheet supported by a second supporting film;

a first transfer step of transferring the ceramic green sheet of at least one second transfer sheet on a lamination stage;

a second transfer step of transferring the composite green sheet of at least one first transfer sheet on the at least one ceramic green sheet that was previously laminated;

a third transfer step of transferring the ceramic green sheet of at least one second transfer sheet on the composite green sheet that was previously laminated; and firing a laminate obtained by the first, second and third transfer steps.

2. A method of manufacturing a laminated ceramic electronic component according to claim 1, wherein a plurality of the first transfer sheets are prepared, and the conductors are formed so that by laminating, the conductors of the plurality of the composite green sheets are electrically connected to form a coil.

3. A method of manufacturing a laminated ceramic electronic component according to claim 2, wherein at least one of the plurality of the conductors is a via hole electrode for connecting the upper and lower conductors.

4. A method of manufacturing a laminated ceramic electronic component according to claim 1, wherein the first ceramic area is made of a magnetic ceramic, and the second ceramic area is made of a non-magnetic ceramic.

5. A method of manufacturing a laminated ceramic electronic component according to claim 1, wherein the ceramic green sheet of the second transfer sheet is made of a magnetic ceramic.

6. A method of manufacturing a laminated ceramic electronic component according to claim 4, further comprising the step of forming the first ceramic area and the second ceramic area by printing a magnetic ceramic paste and a non-magnetic ceramic paste, respectively.

7. A method of manufacturing a laminated ceramic electronic component according to claim 3, further comprising the steps of:

forming the at least one of the first ceramic area and the second ceramic area at a region excluding a region where a via hole electrode is to be formed; and thereafter filling the region where the via hole is to be formed with an electrically conductive paste to form the via hole electrode.

8. A method of manufacturing a laminated ceramic electronic component according to claim 3, further comprising the steps of:

forming a through hole in which a via hole electrode is to be formed after preparing the composite ceramic green sheet; and filling the through hole with an electrically conductive paste to form the via hole electrode.

9. A method of manufacturing a laminated ceramic electronic component according to claim 1, further comprising the steps of:

preparing a third transfer sheet in which a second composite green sheet having a magnetic ceramic area and a non-magnetic ceramic area is supported by a third supporting film; and transferring the second composite green sheet from at least one third transfer sheet between the first transfer step and the third transfer step.

10. A method of manufacturing a laminated ceramic electronic component according to claim 1, wherein the laminated ceramic electronic component is a closed magnetic circuit type laminated common mode choke coil.

11. A method of manufacturing a laminated ceramic electronic component according to claim 1, wherein the laminated ceramic electronic component is an open magnetic circuit type laminated common mode choke coil inductor.

12. A laminated ceramic electronic component comprising a sintered ceramic body produced according to the method as set forth in claim 1, and a plurality of external electrodes disposed on the outer surface of the sintered ceramic body and electrically connected to the conductors in the sintered ceramic body.

13. A laminated ceramic electronic component according to claim 12, wherein the laminated ceramic electronic component is a closed magnetic circuit type laminated common mode choke coil.

14. A laminated ceramic electronic component according to claim 12, wherein the laminated ceramic electronic component is an open magnetic circuit type laminated common mode choke coil inductor.

* * * * *